US009601100B1

(12) United States Patent
Dixon

(10) Patent No.: US 9,601,100 B1
(45) Date of Patent: Mar. 21, 2017

(54) MAGNETIC PICKUP WITH EXTERNAL TONE SHAPER

(71) Applicant: George J. Dixon, Socorro, NM (US)

(72) Inventor: George J. Dixon, Socorro, NM (US)

( * ) Notice: Subject to any disclaimer, the term of this patent is extended or adjusted under 35 U.S.C. 154(b) by 29 days.

(21) Appl. No.: 14/642,381

(22) Filed: Mar. 9, 2015

(51) Int. Cl.
*G10H 3/18* (2006.01)
*G10H 3/14* (2006.01)

(52) U.S. Cl.
CPC ..... *G10H 3/181* (2013.01); *G10H 3/182* (2013.01)

(58) Field of Classification Search
CPC ..... G10H 3/181; G10H 3/182
USPC ..... 84/726, 727, 728
See application file for complete search history.

(56) References Cited

U.S. PATENT DOCUMENTS 2,573,254 A * 10/1951 Fender ..... G10H 3/181 84/307
2,612,072 A * 9/1952 De Armond ..... G10H 3/181 310/155
2,817,261 A * 12/1957 Fender ..... G10H 3/182 84/728
2,892,371 A * 6/1959 Butts ..... G10H 3/181 84/727
2,896,491 A * 7/1959 Lover ..... G10H 3/181 84/725
2,911,871 A * 11/1959 Schultz ..... G10H 3/181 84/725
2,976,755 A * 3/1961 Fender ..... G10H 3/183 84/267
3,236,930 A * 2/1966 Fender ..... G10H 3/181 84/728
4,026,178 A * 5/1977 Fuller ..... G10H 3/183 84/726
4,145,944 A * 3/1979 Helpinstill, II ..... G10H 3/181 84/726
4,220,069 A * 9/1980 Fender ..... G10H 3/182 84/726
4,364,295 A * 12/1982 Stich ..... G10H 3/181 84/726
4,524,667 A * 6/1985 Duncan ..... G10H 3/181 84/728
4,581,974 A * 4/1986 Fender ..... G10H 3/182 84/725
4,878,412 A * 11/1989 Resnick ..... G10H 3/181 336/110
5,221,805 A * 6/1993 Lace ..... G10H 3/181 84/726
5,290,968 A * 3/1994 Mirigliano ..... G10H 3/181 84/726
5,391,831 A * 2/1995 Lace ..... G10H 3/181 84/726

(Continued)

OTHER PUBLICATIONS

Bozorth, Richard, M., "Ferromagnetism", *IEEE Press/Wiley*, Hoboken, 2003, (492 pages).

(Continued)

*Primary Examiner* — David Warren
*Assistant Examiner* — Christina Schreiber
(74) *Attorney, Agent, or Firm* — Leydig, Voit & Mayer, Ltd.

(57) ABSTRACT

A magnetic pickup system comprising a magnetic pickup and a ferromagnetic tone shaper without electrical connections that is magnetically coupled and separately mounted from the pickup on a musical instrument with ferromagnetic strings.

30 Claims, 25 Drawing Sheets

(56) References Cited

U.S. PATENT DOCUMENTS

| | | | | |
|---|---|---|---|---|
| 5,408,043 | A * | 4/1995 | Lace | G10H 3/181 84/726 |
| 5,438,157 | A * | 8/1995 | Lace, Sr. | G10H 3/181 84/726 |
| 5,464,948 | A * | 11/1995 | Lace | G10H 3/181 84/726 |
| 5,908,998 | A * | 6/1999 | Blucher | G10H 3/181 84/723 |
| 6,291,759 | B1 * | 9/2001 | Turner | G10H 3/181 336/110 |
| 7,166,793 | B2 | 1/2007 | Beller | |
| 7,166,916 | B2 * | 1/2007 | Akamatsu | H01L 21/561 257/690 |
| 7,189,916 | B2 | 3/2007 | Kinman | |
| 7,227,076 | B2 * | 6/2007 | Stich | G10H 3/181 84/726 |
| 7,259,318 | B2 * | 8/2007 | Chiliachki | G10H 3/181 84/290 |
| 7,427,710 | B2 * | 9/2008 | Hara | G10H 3/182 84/723 |
| 7,989,690 | B1 * | 8/2011 | Lawing | G10H 3/181 84/723 |
| 8,415,551 | B1 * | 4/2013 | Dixon | G10H 3/181 84/723 |
| 8,553,517 | B2 | 10/2013 | Kim | |
| 8,853,517 | B1 * | 10/2014 | Dixon | G10H 3/181 84/725 |
| 8,907,199 | B1 * | 12/2014 | Dixon | G10H 3/181 84/726 |
| 8,969,701 | B1 * | 3/2015 | Dixon | G10H 3/143 84/723 |
| 9,147,387 | B2 * | 9/2015 | Wolf | G10H 3/181 |
| 2006/0156911 | A1 * | 7/2006 | Stich | G10H 3/181 84/726 |
| 2012/0103170 | A1 * | 5/2012 | Kinman | G10H 3/181 84/726 |
| 2014/0245877 | A1 * | 9/2014 | Gelvin | G10H 3/181 84/727 |
| 2015/0199949 | A1 * | 7/2015 | Fishman | G10H 3/181 84/726 |

OTHER PUBLICATIONS

Bozorth, Richard, M., "Ferromagnetism", *IEEE Press/Wiley*, Hoboken, 2003, (493 pages).

Milan, Mario, "Pickups, Windings and Magnets and the Guitar Became Electric", *Centerstream*, Anaheim Hills, 2007, (216 pages).

Lemme, Helmuth, "Electric Guitar, Sound Secrets and Technology", *Elektor*, Netherlands, 2012, (279 pages).

Strnat, Karl J., "Modern Permanent Magnets for Applications in Electro-Technology", *Proc. IEEE*, vol. 78, pp. 923 (1990).

Errede, Dr. Steven, Presentation entitled: "Electronic Transducers for Musical Instruments", *Proceedings of the Audio Engineering Society at University of Illinois at Urbana-Champaign* on Nov. 29, 2005, published on the internet at http://courses.physics.illinois.edu/phys406/Lecture_Notes/Guitar_Pickup_Talk/Electronic_Transducers_for_Musical_Instruments.pdf, (43 pages).

French, Richard Mark, "Engineering the Guitar, Theory and Practice", *Springer*, New York, 2009, pp. 180-207, (pp. 35 total).

Cullity, B.D., et al., "Introduction to Magnetic Materials", *IEEE Press/Wiley*,. Hoboken, 2008 (285 pages).

Cullity, B.D., et al., "Introduction to Magnetic Materials", *IEEE Press/Wiley*,. Hoboken, 2008 (264 pages).

French, Richard Mark, "Engineering the Guitar, Theory and Practice", *Springer*, New York, 2009, (274 pages).

Hunter, Duncan, "The Guitar Pickup Handbook, the Start of Your Sound", *Backbeat/Hal Leonard*, New York, 2008 (260 pages).

Lemarquand, G., et al., "Calculation Method of Permanent-Magnet Pickups for Electric Guitars", *IEEE Transaction of Magnetics*, vol. 43, pp. 3573-3578 (2007).

* cited by examiner

A

B

MAGNETIC PICKUP WITH EXTERNAL TONE SHAPER

CROSS-REFERENCE TO RELATED APPLICATIONS

The present invention relates to magnetic pickups for sensing vibration in a stringed musical instrument and, more specifically, to musical instrument pickup systems comprising a magnetic pickup and a passive external ferromagnetic tone modifier.

BACKGROUND OF THE INVENTION

String motion sensors, commonly known as pickups, are installed on guitars, bass guitars, mandolins and other stringed musical instruments to convert the sound produced by the vibrating strings to an electronic signal. In various applications, the signal generated by a pickup may be modified by analog or digital processors, amplified or recorded before it is converted back to acoustic vibrations by a speaker or other output transducer. Conventional musical instrument pickups use different physical principles, including variations in magnetic reluctance, the Hall effect, and the piezoelectric effect, to detect the motion of musical instrument strings.

A large fraction of the pickups that have been manufactured to date comprise a permanent magnetic source and at least one set of ferromagnetic pole pieces that are surrounded by one or more wire coils. Pickups of this general design are commonly referred to as 'magnetic pickups' and are mounted close enough to the ferromagnetic strings of a guitar, bass, or other lute-type stringed instrument to induce a magnetic field in the strings. Vibrational motion of one or more strings produces corresponding magnetic flux variations in the pickup that generate an electrical output signal in the wire coil.

Analytically, a mounted magnetic pickup and the ferromagnetic strings of a musical instrument may be modeled as a magnetic circuit with a three dimensional magnetic flux distribution that changes in response to string vibrations. A mathematical analysis of magnetic pickup operation under a simplified set of operational parameters is provided in "Calculation Method of Permanent-Magnet Pickups for Electric Guitars" by G. Lemarquand and V. Lemarquand, *IEEE Transaction of Magnetics*, Vol. 43, pp, 3573-3578 (2007). In general, the electronic output signal of a magnetic pickup is not an exact representation of the acoustic vibrations of the strings on an instrument and the musicality of the output signal may be increased by harmonic distortion within the pickup. The harmonic spectrum of a pickup output signal is typically affected by its basic design, the winding pattern and tension of the one or more coils that surround the pole pieces, and by the ferromagnetic losses of the pickup components. The design and manufacture of a pickup with desirable musical qualities is an art in which the physical processes that affect the output spectrum are controlled and balanced.

Magnetic pickups came into common usage during the 1950's when hard ferromagnetic material and sensor technologies evolved to a point that the pickups could be economically mounted on a musical instrument. For purposes of clarity, the features of the present invention will be discussed with reference to solid body guitars with ferromagnetic strings. It will, however, be obvious to those skilled in the art that the scope of the invention is not limited to the illustrative guitar designs and magnetic pickup systems that embody features of the invention may be mounted on many different instruments. These instruments may have bodies with solid, semi-solid and hollow structures, various output frequency ranges and include, but are not limited to, bass guitars, Spanish-style guitars, 12-string guitars, mandolins, and steel guitars.

Magnetic musical instrument pickups may be classified into broad categories that reflect differences in basic design and tonal quality. Pickups in the 'conventional single coil' category have key design features that are shared by the devices disclosed in U.S. Pat. No. 2,612,072 issued to H. de Armond on Sep. 30, 1952, U.S. Pat. No. 2,573,254, U.S. Pat. No. 2,817,261, U.S. Pat. No. 3,236,930, and U.S. Pat. No. 4,220,069 respectively issued to Leo Fender on Oct. 30, 1951, Dec. 24, 1957, Feb. 22, 1966, and Sep. 2, 1980 and U.S. Pat. No. 2,911,871 issued to C. F. Schultz on Nov. 10, 1959. The 'single coil' designation derives from the fact that pickups in this category comprise a set of string-sensing ferromagnetic pole pieces with a magnetic flux that is linked by a single, string-sensing coil of wire. Some single coil pickups have pole pieces that are formed from magnetized hard ferromagnetic materials that generate the flux in the pickup. In other single coil designs a separate permanent magnet induces magnetic fields in the pole pieces. Conventional single coil pickups have no means for external noise rejection and are sensitive to external electromagnetic noise sources.

The external noise sensitivity of a magnetic pickup may be significantly reduced by adding a second wire coil to the pickup. The second coil is designed to generate an electronic output signal at its terminals with a noise component that is similar to the noise output of the first coil. Noise reduction is accomplished by connecting the two coils so that the noise signals have opposite phases.

Noise-cancelling single coil pickups have tonal characteristics similar to those of conventional single coil pickups and typically comprise a single set of string-sensing poles, a string-sensing coil, and a noise-cancelling coil that is connected to the string-sensing coil. In some designs, the noise-cancelling coil links the flux in a set of passive pole pieces. Illustrative noise-cancelling single coil pickups are disclosed in U.S. Pat. No. 7,166,793 issued to Kevin Beller on Jan. 23, 2007, U.S. Pat. No. 7,189,916 issued to Christopher I. Kinman on Mar. 13, 2007, and U.S. Pat. No. 7,227,076 issued to Willi L. Stich on Jun. 5, 2007.

Noise-reducing humbucking pickups or 'humbuckers' share key design features with the devices that are disclosed in U.S. Pat. No. 2,896,491 ('491) issued to Seth Lover in Jul. 28, 1959 and U.S. Pat. No. 2,892,371 ('371) issued to J. R. Butts on Jun. 30, 1959. Pickups in this category have at least two string-sensing coils that each link the magnetic flux in separate sets of string-sensing pole pieces. The magnetic field direction in the poles and the direction of signal propagation in each of the two coils are selected so that a large portion of the string-generated signals from the coils have an in-phase, additive relationship and a large percentage of the common-mode noise signals from the two coils have an out-of-phase, subtractive relationship. In many cases, the output signal amplitude of a humbucker-style pickup is greater than that obtained from single coil pickups and the output noise signal is smaller.

U.S. Pat. No. 2,976,755 ('755) issued to Clarence L. Fender on Mar. 28, 1961 describes a different type of noise reducing pickup in which the two sets of string sensing pole pieces sense the motion of different strings. As in the humbucker pickup designs of Lover and Butts, the two sets of pole pieces are magnetized in opposite directions and surrounded by separate coils that are connected in a noise-cancelling configuration. Other pickups that share the design features of the Precision Bass (P-Bass) pickups that are disclosed in the '755 patent include the Z-shaped pickups that are installed as standard equipment on the Comanche model guitars that are manufactured by G&L Guitars of Fullerton, Calif. and the split blade Stratocaster-style pickups that are manufactured by Fralin Pickups of Richmond, Va.

Each of the categories outlined above may be further subdivided according to the geometry of the string-sensing pole pieces. In the most common configuration, the string-sensing surface of the pole pieces has an approximately circular geometry and each pole piece senses the vibration of a single instrument string. In alternative configurations the vibrations of multiple strings are sensed by plates of ferromagnetic material that are at least partially surrounded by a wire coil. U.S. Pat. No. 4,364,295 issued to Willi Stich on Dec. 21, 1982, for example, discloses a humbucking design with soft ferromagnetic pole plates and the single pole piece of 'lipstick-style' pickups is a magnetized bar of hard ferromagnetic material.

In other designs, magnetic pickups may have multiple pole pieces that are each surrounded by a separate wire coil. These designs significantly reduce the intermodulation of signals from different strings and, in certain cases, have multiple output wires that allow the signals from each string to be separately transferred from the instrument to an external audio electronic system. The Z-coil design that is disclosed in U.S. Pat. No. 7,989,690 issued to Andrew Lawing on Aug. 2, 2011 and the noise-cancelling design that is disclosed in U.S. Pat. No. 7,427,710 issued to Koji Hara are examples of pickups that have multiple pole pieces that are surrounded by individual coils.

Electromagnetic noise from a pickup may also be reduced by connecting it to an external, noise-sensing coil in such a way that the noise signals from the external coil and the pickup are dephased. External sensing coils are typically mounted on the instrument in positions that are physically separated from the pickup and, therefore, sense an electromagnetic noise field that is different from the noise field that is detected by the pickup coils. In many cases, however, the difference between signals in the pickup and coil are small and effective noise cancellation can be achieved. Illustrative pickup systems with external noise-cancelling coils are disclosed in U.S. Pat. No. 7,259,318 issued to Ilitch S. Chiliachki on Aug. 21, 2007 and U.S. Pat. No. 4,581,974 issued to C. Leo Fender on Apr. 15, 1986.

Active circuitry is incorporated into some magnetic pickups to decrease the output impedance of the pickup, increase the output amplitude and, in some cases, modify the pickup tone. Active magnetic pickups with different coil and pole piece designs are manufactured, for example, by EMG, Inc. of Santa Rosa, Calif.

The design and manufacture of magnetic musical instrument pickups are described from an historical and lay engineering perspective in *The Guitar Pickup Handbook, the Start of Your Sound* by Duncan Hunter (Backbeat/Hal Leonard, New York, 2008), *Pickups, Windings and Magnets and the Guitar Became Electric* by Mario Milan (Centerstream, Anaheim Hills, 2007) and *Electric Guitar, Sound Secrets and Technology* by Helmuth Lemme (Elektor, Netherlands, 2012). On a more technical level, *Engineering the Guitar, Theory and Practice* by Richard Mark French (Springer, New York, 2009) contains a chapter on Guitar Electronics and a thorough treatment of musical sound quality and tone as viewed from an engineering and physics perspective. A technical analysis of the history and operation of guitar pickups is also provided by the slides from a seminar entitled "Electronic Transducers for Musical Instruments," that was given by Dr. Steven Errede at a meeting of the Audio Engineering Society at University of Illinois at Urbana-Champaign on Nov. 29, 2005 and published on the internet at http://courses.physics.illinois.edu/phys406/Lecture_Notes/Guitar_Pickup_Talk/Electronic_Transducers_for_Musical_Instruments.pdf.

BRIEF SUMMARY OF THE INVENTION

The present invention provides a magnetic musical instrument pickup system with improved tonal qualities that are obtained by mounting a magnetic pickup and a ferromagnetic tone shaper in different positions on a musical instrument with ferromagnetic strings. The ferromagnetic tone shaper has no electrical connections and is magnetically coupled to the pickup so that the magnetic interaction between the tone shaper and pickup modify the output tone of the pickup. The invention further provides a method for changing the tone of a pickup by mounting a ferromagnetic tone shaper near the pickup and a means for altering the tone of a magnetic pickup with a ferromagnetic tone shaper.

In some embodiments, a magnetic pickup system according to the present invention comprises a magnetic pickup and a ferromagnetic tone shaper without electrical connections that are magnetically coupled but physically separated when they are mounted in a musical instrument. The magnetic pickup comprises at least one ferromagnetic string-sensing pole piece and a magnetic source. The string-sensing pole pieces may be magnetized or unmagnetized and, in certain cases, the pole pieces comprise the magnetic source. Each string sensing pole piece is at least partially surrounded by a wire coil that links a portion of the flux in the pole piece and, in different designs, separate coils may surround different groups of one or more pole pieces or a single coil may surround all of the pole pieces in the pickup. The magnetic pickup further comprises a mounting structure that holds the pickup components in stable relative positions and facilitates attaching the pickup to the musical instrument.

The magnetic pickup may have a wide range of different designs that include, but are not limited to, conventional single coil, noise-cancelling single coil, and humbucker, in addition to P-bass, Z-coil and similar designs in which the vibration of two or more groups of one or more instrument strings generate outputs in separate pickup coils.

The tone shaper comprises at least one component that is formed from a hard ferromagnetic material or from a material that comprises a granular ferromagnetic material and a binder. In certain embodiments, the tone shaper may additionally comprise one or more components that are fabricated from soft ferromagnetic materials, hard ferromagnetic materials, nonferromagnetic conductors, or bound ferromagnetic granules.

The harmonic output spectrum of the pickup system is determined by physical parameters that include, but are not limited to, the number of tone shaper components, their physical dimensions, and the materials from which they are formed. The output spectrum is also typically influenced by the ferromagnetic loss coefficients and magnetic permeability of the tone shaper components and by the magnetization states and polar orientations of any tone shaper components that are formed from hard ferromagnetic materials.

Depending on the number, sizes, shapes, and relative positions of the tone shaper components with respect to the pickup, they may be affixed to the instrument using various conventional means that include, but are not limited to, tapes, adhesives, brackets and fasteners. They may also be incorporated into pickup rings, pickguards or other structural components of the musical instrument by fabricating the component from the tone shaper material or by embedding the tone shaper in the component. The magnetic pickup is typically mounted and attached to the musical instrument using conventional techniques and hardware.

In some embodiments the tone shaper comprises a component that is fabricated from a hard ferromagnetic material with tonal properties that are determined, at least in part, by the composition, structure and magnetization state of the material. Suitable hard materials, include, but are not limited to, Alnico alloys and other hysteresis materials having a desirable set of ferromagnetic loss parameters and bonded permanent magnet materials that are easily shaped and attached to the instrument.

In other embodiments the tone shaper comprises a component that is formed from bound ferromagnetic granules. The properties of the materials that comprise a granular ferromagnetic material and a binder may be varied over wide ranges by adjusting the composition, concentration, or size of the granules or the conductivity of the binding material. Granulated ferromagnetic materials may be hard or soft ferromagnetic materials and, in some embodiments, the granules comprise an Alnico alloy or other hysteresis material. Granules of two or more materials with different ferromagnetic properties may also be combined in a binder to obtain a unique set of integrated properties that cannot be obtained with a single material. The binder is typically an insulating material with good structural properties but, in some embodiments, a conductive binder may be used to increase the eddy current loss coefficient of a material. Suitable insulating binders include, but are not limited to, epoxies, urethane mold-making compounds and acrylic art media.

In some embodiments, ferromagnetic tone shapers may comprise a hard ferromagnetic or bound granular component and one or more additional components that are formed from different materials. The additional components typically affect the magnetic field distribution or the integrated ferromagnetic losses of a tone shaper and may be fabricated from hard ferromagnetic and bound granular materials, soft ferromagnetic materials, or nonferromagnetic conductors.

In alternative embodiments, a magnetic pickup system according to the invention may comprise a magnetic pickup and a composite tone shaper that has no electrical connections. The composite tone shaper comprises two or more components that are formed from ferromagnetic materials with dissimilar properties. When the pickup system is mounted in a musical instrument with ferromagnetic strings, the composite tone shaper is magnetically coupled to the pickup but is not physically attached or electrically connected to it.

The magnetic pickup comprises at least one ferromagnetic string-sensing pole piece and a magnetic source. The string-sensing pole pieces may be magnetized or unmagnetized and, in certain cases, the pole pieces comprise the magnetic source. Each string-sensing pole piece is at least partially surrounded by a wire coil that links a portion of the flux in the pole piece and, in different designs, a single coil may surround a set of pole pieces with elements that range in number from a single pole piece to all of the pole pieces in the pickup. The magnetic pickup further comprises a mounting structure that holds the pickup components in stable relative positions and facilitates attaching the pickup to the musical instrument.

The composite ferromagnetic tone shaper comprises at least two ferromagnetic components that are fabricated from materials with different ferromagnetic properties. It is mounted to magnetically interact with the magnetic pickup when the pickup system is attached to a musical instrument. Depending on the design features of the instrument and the composite shaper, the shaper may be attached to a pickup mounting ring, a pickguard, the body of the instrument, a bridge plate, or to another suitable structure.

The ferromagnetic components of a composite tone shaper may be formed from any combination of dissimilar ferromagnetic materials and hard ferromagnetic components may have arbitrary states of magnetization. In addition to at least two ferromagnetic components with dissimilar ferromagnetic properties, composite tone shapers may further comprise components that are fabricated from nonferromagnetic conductors.

The invention is further embodied in methods for retrofitting and changing the tonal properties of a magnetic pickup that is mounted in a musical instrument with ferromagnetic strings. These methods comprise the step of attaching a ferromagnetic tone shaper that has no structural support function to the instrument so that the tone shaper is magnetically coupled to the magnetic pickup but electrically disconnected and spatially separated from it.

The magnetic pickup comprises at least one ferromagnetic string-sensing pole piece and a magnetic source. The string-sensing pole pieces may be magnetized or unmagnetized and, in certain cases, the pole pieces comprise the magnetic source. Each string sensing pole piece is at least partially surrounded by a wire coil that links a portion of the flux in the pole piece and, in different designs, a single coil may surround a set of pole pieces with elements that range in number from a single pole piece to all of the pole pieces in the pickup. The magnetic pickup further comprises a mounting structure that holds the other pickup components in stable relative positions and facilitates attaching the pickup to the musical instrument.

The nonstructural tone shaper comprises at least one component that is formed from a ferromagnetic material and, in different embodiments, tone shaper components may be attached to a pickup mounting ring, a pickguard, a musical instrument body, a bridge plate or other structure. In some embodiments a tone shaper may have a composite structure and include additional components that are formed from nongranular ferromagnetic materials or granular ferromagnetic materials in a binder. The nonstructural tone shaper may be attached to a structural component of the musical instrument or embedded in an instrument component. In those cases where the pickup is attached to a musical instrument structure, the structure may be selected from the group of pickup mounting rings, pickguards, bridge plates and musical instrument bodies. In cases where the tone shaper is embedded in an instrument structure the tone shaper is attached to the instrument by replacing a corresponding instrument structure with the tone shaping structure.

The invention is further embodied in a magnetic pickup system comprising a magnetic pickup and a means for shaping the tone of the pickup without contacting the pickup. When the system is attached to an instrument to sense string vibration, the tone shaping means does not support or stabilize other instrument components. The tone of the pickup is at least partially determined by a magnetic interaction between the tone shaping means and the pickup but it does not communicate electrically with the means.

The magnetic pickup comprises at least one ferromagnetic pole piece, a wire coil that surrounds at least a portion of the pole piece, a magnetic source the creates a magnetic field distribution in the pole piece and a supportive means for holding the magnetic source, pole pieces and coil in substantially stable relative positions and enabling their attachment to the instrument.

In various embodiments, the magnetic pickup may be a single coil pickup or it may have two or more coils and the tone shaping means may comprise a hard ferromagnetic material, a bound granular ferromagnetic material or it may have a composite structure with two or more dissimilar ferromagnetic materials. The means may be attached to various musical instrument structures including bridge plates and pickguards.

BRIEF DESCRIPTION OF THE SEVERAL VIEWS OF THE DRAWING(S)

DETAILED DESCRIPTION OF THE INVENTION

Figure 1:
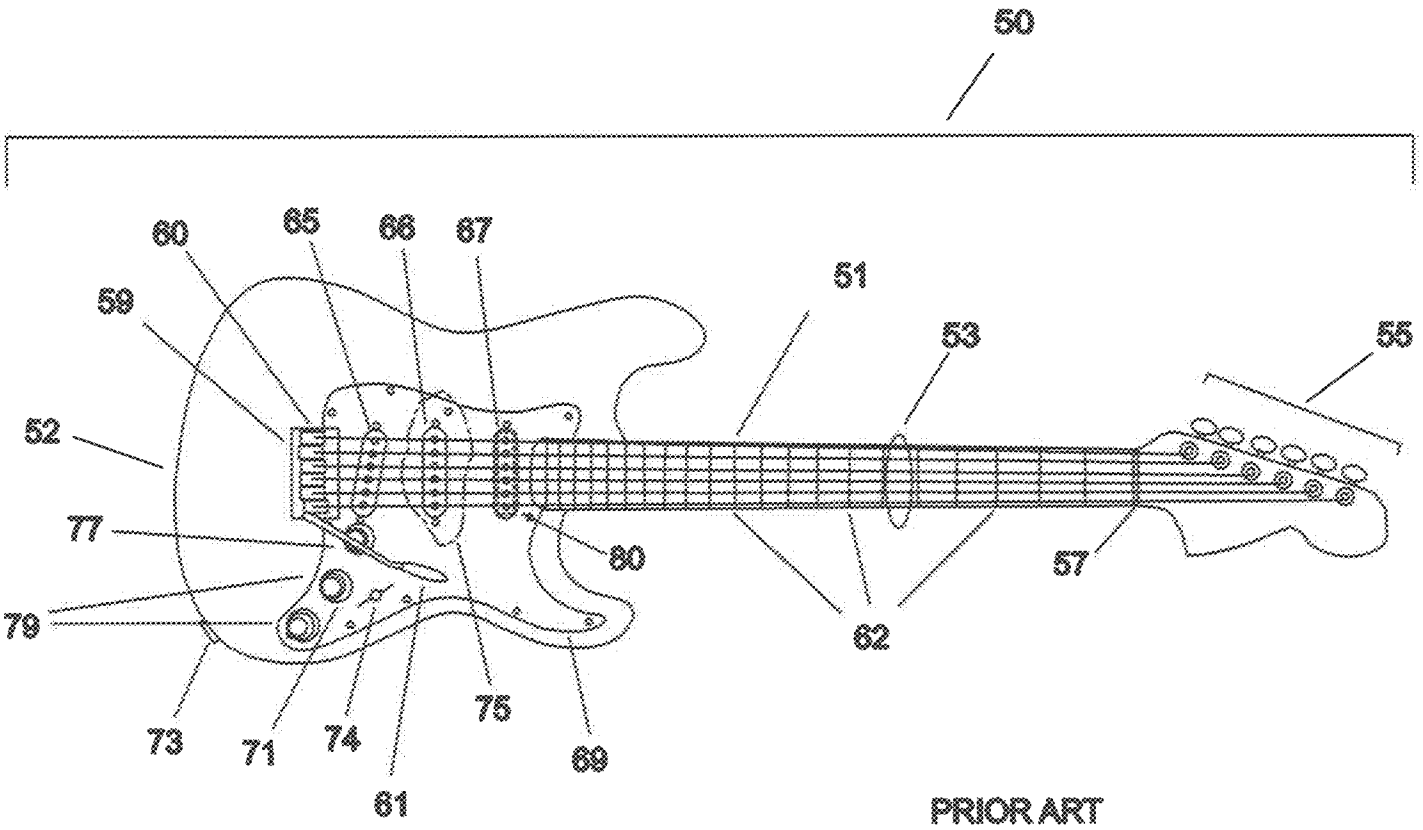
PRIOR ART FIGURE 1
FIG. 1 is an orthographic top projection drawing illustrating the components of a Stratocaster-style guitar.

In its various embodiments, the present invention comprises a magnetic musical instrument pickup and a passive ferromagnetic tone shaper that is magnetically coupled to the pickup to alter its tone. The tone shaper is mounted separately from the pickup on a musical instrument and is not electrically connected to the pickup or other circuits in the instrument. Magnetic interaction between the pickup and the tone shaper alters the tone of the pickup by changing at least one of the spatial magnetic field distribution and ferromagnetic losses of the magnetic circuit that comprises the pickup and strings.

The terms 'musical tone,' and 'tonal quality' are commonly used by those skilled in the art of musical instrument and pickup design to refer to a set of physical parameters that determine the musical qualities of the sound emanating from an instrument or component as perceived by a human observer. In this patent application, the terms 'pickup tone,' 'tonal quality,' and 'sound quality' will be used interchangeably to describe the contributions of a magnetic pickup to the perceptual features of a sound generation process.

A magnetic pickup is typically mounted on an instrument and generates and electronic signal that is related to the sound produced by the vibrating strings on the instrument. The output of the pickup is commonly routed through a control circuit on the instrument and through one or more external signal processing and amplification stages before being converted to sound by a speaker. Because it senses string motion and generates the electronic signal that is amplified and modified by downstream components, the sound quality of a pickup plays a significant role in determining the overall tone of an amplified instrument. Sound qualities that are lost in the process of string vibration sensing are also lost to subsequent stages of the signal processing and amplification process.

According to R. M French in the chapter of *Engineering the Guitar, Theory and Practice* entitled "Sound Quality" (pp 180-207, Springer, New York, 2009), "few topics are more controversial than sound quality. Skilled players and experienced listeners generally agree on subjective rankings of instruments, but the differences are notoriously difficult to measure and to describe using objective metrics." Like flavor, artistic quality, and other variables that describe the properties of an item in terms of its effect on human perception, good sound quality and tone are readily recognized by a knowledgeable individual but impossible to completely quantify using physical measurement parameters. Embodiments of the present invention may be used to generate new tones that were heretofore unobtainable. They additionally allow the tonal properties of a magnetic pickup to be adjusted by a musician, luthier or other end user to achieve an output that is more pleasing to her ear.

Magnetic instrument pickups are commonly mounted on musical instruments with different designs. In this application, the features of the present invention will be illustrated in the context of well-known 6-string and bass guitar designs but those skilled in art will realize that embodiments of the present invention may be used to shape the output tone of any instrument that uses a magnetic pickup to convert the vibration of ferromagnetic instrument strings to an electrical output signal. Such instruments include bass and electric Spanish-style guitars with solid, hollow, semi-hollow or chambered bodies and conventional and nonstandard numbers of strings. They further include mandolins, lap steel guitars, banjos and other instruments with ferromagnetic strings.

FIG. 1 illustrates a conventional, solid-bodied, Stratocaster-style guitar 50 with three single coil pickups 65, 66, 67. The neck 51 is typically attached to the body 52 with screws and the three pickups 65, 66, 67 are mounted on a pickguard 69 that is typically fastened to the body 52 with screws. The guitar 50 has six ferromagnetic strings 53 that vibrate with fundamental frequencies that are determined by the composition, diameter, and tension of the strings and by the length over which they oscillate. In the guitar 50, one end of each string is attached to a block on the underside of the tremolo bridge 59 and the oscillating length of each string is equal to the distance between the nut 57 and the one of the adjustable saddles 60 over which the string passes. The other end of each string is attached to one of a set of six machine heads 55 that is turned to adjust the string tension. To raise the fundamental vibrational frequency of a string, a musician shortens its length by pressing the string against a fret, such as one of the frets 62. The frequency difference between adjacent frets is typically equal to a half step on the musical scale and the neck of a conventional Stratocaster guitar allows the frequency of a single string to be tuned over a range of nearly two octaves. The tremolo bridge 59 also allows a musician to simultaneously change the tensions (and frequencies) of the six strings 53 over a smaller range by moving the tremolo bar 61.

The output signals from each of the three single coil pickups 65, 66, 67 are routed through a control circuit 71 to the output jack 73 that facilitates connecting the guitar to a tone modification circuit, amplifier or recording device. The tone circuit 71 of a typical Stratocaster guitar consists of a 5-way switch 74 that is used to connect one or more of the pickups 65, 66, 67 to the output jack, a single volume potentiometer 77, and two tone potentiometers 79. In a typical instrument the tone potentiometers are individually connected to the neck pickup 67 and middle pickup 66 while the 5-way switch is configured to connect any one of the pickups 65, 66, 67 and the combinations of bridge 65 and 66 middle or neck 67 and 66 middle to the output jack 73. Numerous modifications to this circuit have been developed and more complex control circuits are offered by various manufacturers including, for example, ToneShaper of Vero Beach, Fla.

Figure 2:
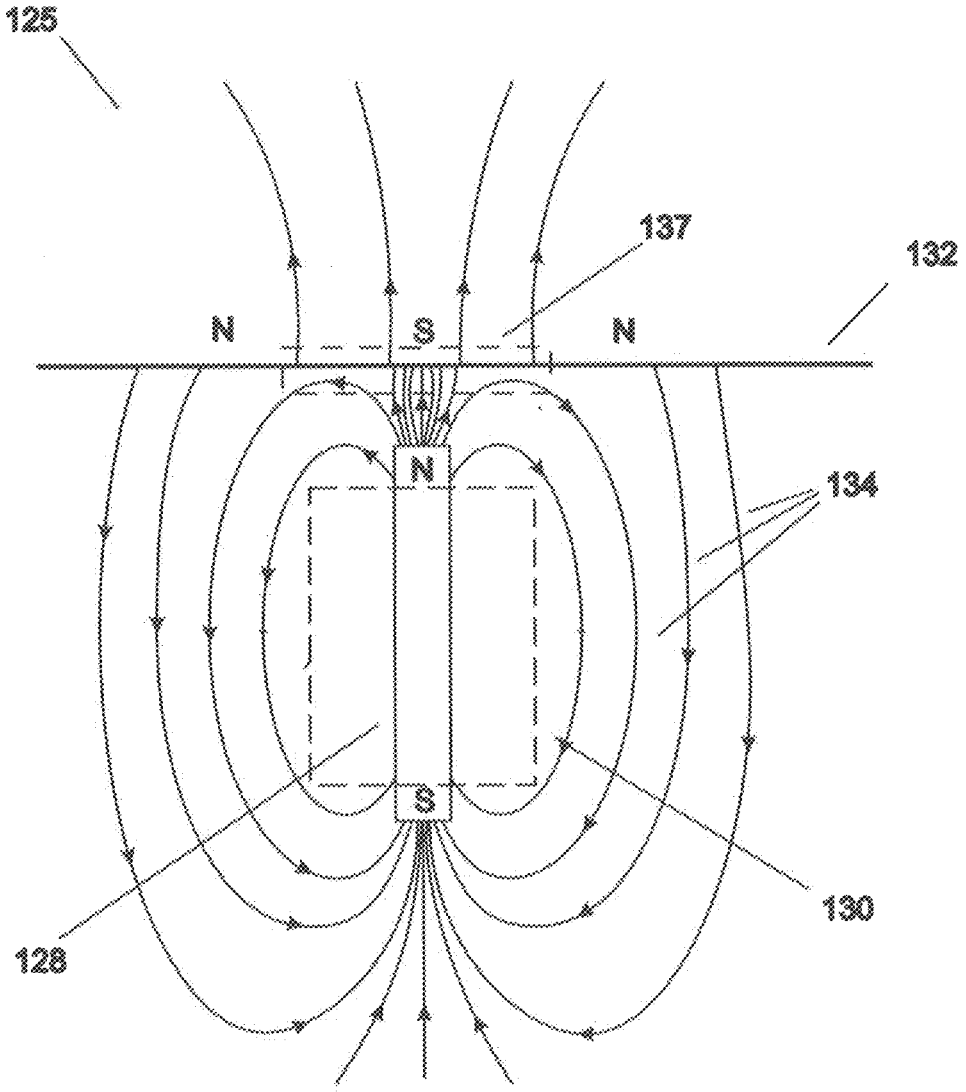
PRIOR ART FIGURE 2
FIG. 2 is a drawing that qualitatively illustrates the magnetic field distribution of a magnetic pickup pole and a ferromagnetic string.

Magnetic pickups sense the motion of a ferromagnetic string by inducing a magnetic field in the string and sensing the variations in magnetic flux that accompany string motion. The magnetized region of the strings over which their vibrational motion appreciably influences the flux that is linked by the pickup coil is determined by the spatial distribution of the magnetic field in the pickup and strings. FIG. 2 qualitatively illustrates the magnetic field distribution around a simplified magnetic pickup 125 that comprises a single permanent magnet pole piece 128 and a wire coil 130. For purposes of clarity, the wire coil that surrounds the pole piece 128 is represented by a dotted rectangle. The pickup 125 is positioned to sense the motion of the ferromagnetic string 132 and the magnetic field distribution in the pickup and strings are conventionally represented by closed magnetic lines of force 134 that connect the North (N) and South (S) magnetic poles of the pole piece 128. The pole piece 128 has a cylindrical shape and is formed from an Alnico alloy or an alternative hard ferromagnetic material. It is magnetized along the cylinder axis so that surface nearest the string is a North magnetic pole.

The string 132 is formed from music wire or an alternative high permeability soft ferromagnetic material and is inductively magnetized with the indicated magnetic polarities by the pole piece 128. A portion of the magnetic flux that is generated by the magnetic pole piece 128 travels through the string 132 and the string and pole piece are said to be magnetically coupled. The three dimensional magnetic field that permeates the string, the pole piece and the surrounding volume is commonly referred to as an open magnetic circuit.

When the string is plucked or strummed by a musician, the magnitude and the distribution of magnetic flux varies throughout the magnetic circuit. Changes in the portion of the magnetic circuit that is surrounded and linked by the coil 130 generate an electronic output signal at the coil output terminals. The frequency spectrum of the output signal is partially determined by the amplitudes of the standing wave harmonics in the portion of the string that is strongly coupled to the pickup. The strongly-coupled portion of the string that is primarily responsible for generating the output signal is referred to in this application as the magnetic window of the pickup.

In the present application, the terms 'coil' and 'wire coil' are used interchangeably to refer to the multiturn conductive paths that generate an output signal by linking the time-varying magnetic flux in the pole pieces of a magnetic pickup. In most pickups, the conductive paths comprise coils of insulated wire but, in some novel designs, such as the Fluence pickups that are manufactured by Fishman Transducers of Andover, Mass., the multiturn conductive paths may comprise an interconnected stack of conductively patterned substrates or other innovative structures.

Figure 3:
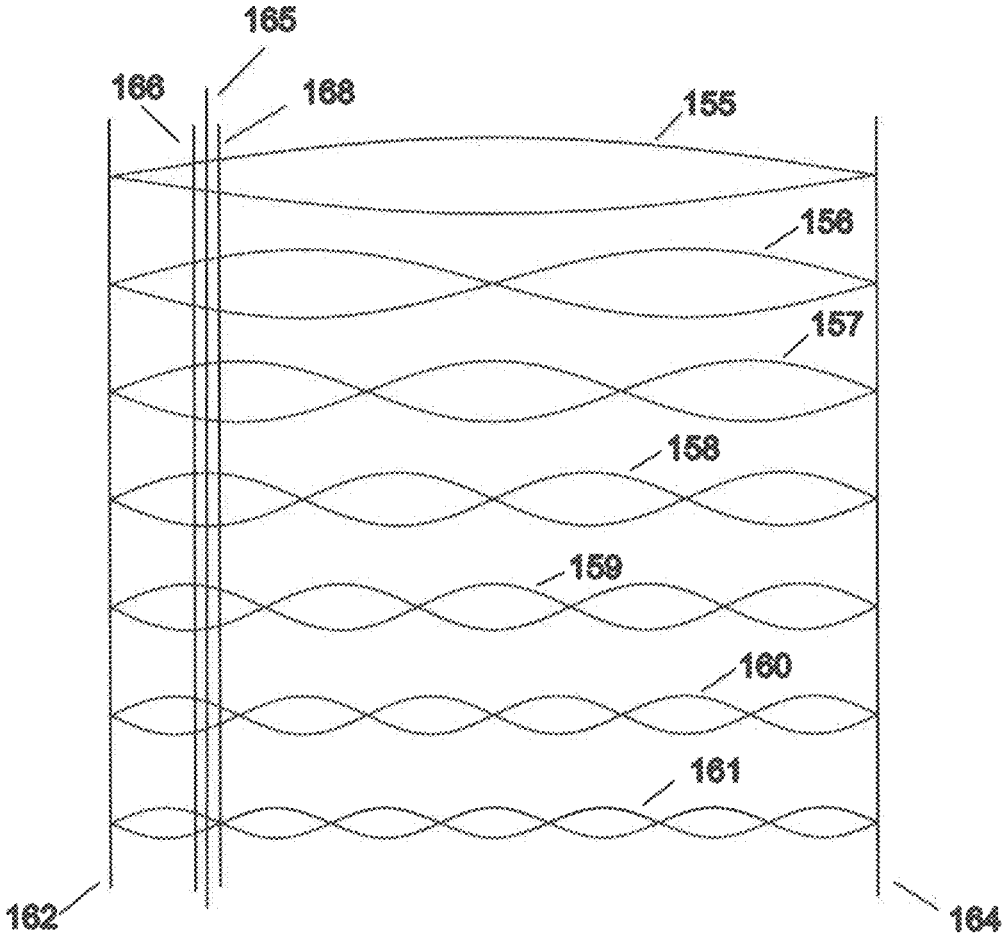
PRIOR ART FIGURE 3
FIG. 3 is a drawing of the standing wave harmonic modes of a ferromagnetic musical instrument string.

FIG. 3 illustrates the fundamental standing wave pattern 155 and the first six higher order harmonic wave patterns 156-161 of a string that is constrained at the end positions 162, 164. In the Stratocaster-style guitar 50 that is illustrated in FIG. 1, the position 162 is the location where the string contacts one of the saddles 60 and the position 164 is the location where the string contacts the nut 57 or one of the frets 62. When a string is plucked or strummed, it vibrates in a combination of the standing wave vibrational modes 155-160 and, in some cases, additional higher order modes. The vibration of the string at the position 165 can be described by a mathematical series of sinusoidally-varying terms with frequencies and coefficients that are determined by the frequencies and relative amplitudes of the vibrational modes.

When a pole piece is positioned to induce a magnetic field about the point 165, it magnetizes the string and senses its motion over a length of the string that is bounded by the points 166 and 168. The relative magnitude of the output signal that is contributed by each mode is proportional to the magnitude of its vibration between the points 166,168. If, for example, each of the modes that are illustrated in FIG. 3 vibrate with the same maximum amplitude, the component of the pickup output that is generated by the fourth vibrational harmonic 158 will have the greatest amplitude and the output amplitude generated by the sixth vibrational harmonic 161 will be smallest. Increasing the length over which the pickup can sense string motion typically increases the amplitude of the output and the number of vibrational harmonics that contribute appreciably to the output signal.

Magnetic pickups typically sense the motion of two or more strings and the pickup tone is partially determined by the distance between the pickup and the bridge of the instrument. The single coil pickups 65, 66, and 67 are attached to the Stratocaster guitar 50 that is illustrated in FIG. 1 at different distances from the bridge saddles 60 so that each pickup senses a different vibrational mode spectrum. The magnetic window over which a single pickup senses vibrational motion can be represented as a two dimensional shape in a plane that is tangent to the approximately cylindrical curved surface defined by the strings at the center of the neck. The magnetic window of a conventional Stratocaster-style single coil pickup, such as the pickup 67, is relatively narrow and is approximately illustrated by the dotted rectangle 80.

The output frequency spectrum of a pickup that is mounted in a musical instrument with ferromagnetic strings is dependent on the size and shape of the pickup's magnetic window, the ferromagnetic material properties of the pickup components, and the ferromagnetic properties of the strings. Ferromagnetic losses in the tone shaper also play a key role in determining the output frequency spectrum of many pickup systems that embody features of the present invention. A basic knowledge of the formalism that used to describe ferromagnetic material properties is, therefore, required to fully understand the operating principles of the invention and will be briefly reviewed herein. Rigorous treatments of ferromagnetic material properties are found in *Ferromagnetism* by Richard M. Bozorth (IEEE Press/Wiley, Hoboken, 2003) and *Introduction to Magnetic Materials* by B. D. Cullity and C. D. Graham (IEEE Press/Wiley, Hoboken, 2008).

When a DC current passes through a long solenoidal coil with an air core, a magnetic field is generated in a direction that is parallel to the axis of the coil. The strength of the magnetic field, H, in Oersteds, is related to the current flowing through the coil, i, in amperes, by:

$$H=i(4\pi/10)(n/L),$$

where (n/L) is the number of turns per centimeter of solenoid length in the axial direction. When a ferromagnetic material is inserted in the solenoid, the magnetic induction within the material, B, in Gauss is related to the magnetic field, H, by the following expression:

$$B=\mu H+4\pi M$$

where μ is the permeability of the ferromagnetic material and M is the magnetization within it. The magnetization, M, reflects the contribution of magnetic domains within the material to the induction, B. Its value is dependent on the orientation of the domains as determined by the magnetic history of the material and on the magnitude and frequency of the magnetic field, H. In ferromagnetic materials, the permeability may be defined as the derivative of the induction, B, with respect to the field strength, H at a given value of H. The value of the permeability approaches unity (saturates) at high magnetic field strengths.

A ferromagnetic material is said to be 'hard' if it takes an appreciable magnetic field to change the domain alignment and 'soft' if the required field is comparatively small. The stability of the magnetization in 'hard' materials makes them generally useful as permanent magnets while 'soft' materials are commonly used as pole materials in motors and other magnetic devices and as core materials in inductors, transformers, and solenoidal antennas. When compared to soft ferromagnetic materials, the saturating field strengths of hard ferromagnetic materials are larger and their permeabilities are significantly smaller in external fields with magnitudes that are well below saturation.

The variation of the magnetic induction, B, in a ferromagnetic material that is placed in an external magnetic field with a magnitude, H, is dependent on the prior history of the material and can be described by the major and minor hysteresis curves of the material. The major hysteresis curve describes the magnetization in a material when the applied field is slowly cycled between large positive and negative values and the initial magnetization curve describes the transition between a zero field state in which the magnetic domains are unoriented and in a saturated state in which all of the domains are aligned in the field direction.

Figure 4:
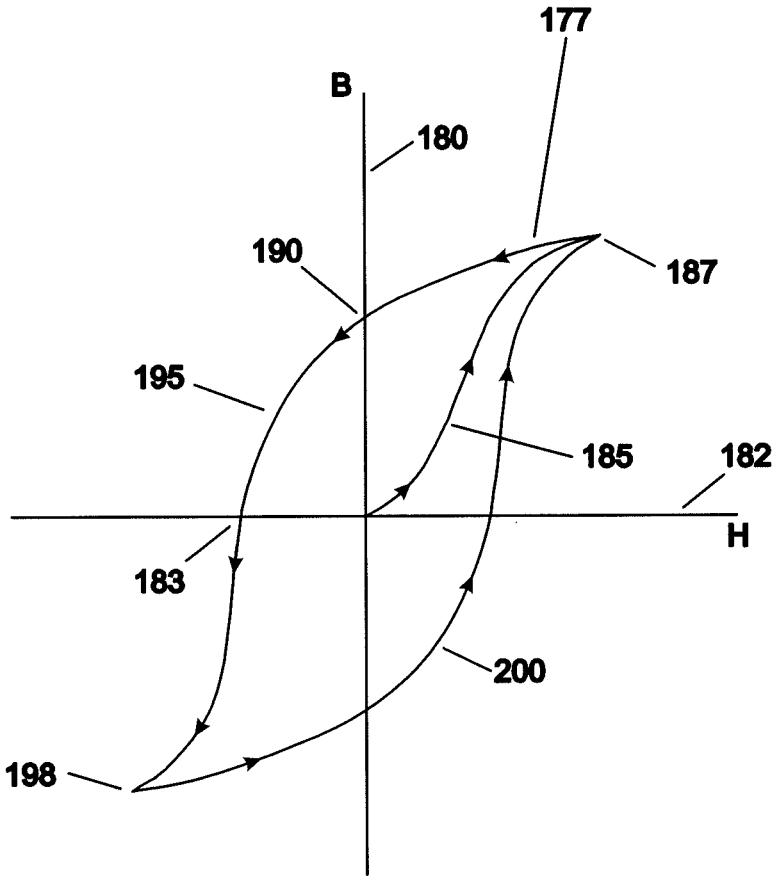
FIG. 4 is a two dimensional graph of a representative major hysteresis curve.

FIG. 4 illustrates a graph of the initial magnetization curve 185 and major hysteresis curve 177 of a representative ferromagnetic material. In this graph, the value of the magnetic induction in the material, B, is represented along the vertical axis 180 and the value of the applied magnetic field, H, is represented along the horizontal axis 182. If the material is initially unmagnetized and the applied field, H, is equal to zero, the magnetic induction, B, is also zero and the state of the material is represented by a point at the origin. As the applied magnetic field is increased, the magnetic induction increases along the initial magnetization curve 185 until the magnetization in the material saturates at the point 187.

If the value of H is increased beyond the saturation point 187 then decreased, the induction, B, decreases along the major hysteresis curve 177. The portion 195 of the curve 177 that falls within the second quadrant of the graph, where H is negative and B is positive, describes the variation of induction with applied field for a material that has been previously magnetized in a direction that is antiparallel to the applied field direction and is known as the 'demagnetization curve' for the material. Demagnetization curves for hard ferromagnetic materials are useful in the design of electromagnetic machinery and are commonly published the by manufacturers of permanent magnet materials.

The magnetization of the previously-saturated material gives rise to a non-zero residual induction when the strength of the applied field is equal to zero and the value of the induction at the positive Y intercept 190 of the major hysteresis curve is commonly referred to as the "remanence" of the material. This parameter is one of the fundamental properties used to describe permanent magnetic materials.

As the magnetic field, H, takes on increasingly negative values, the magnetic induction, B, decreases along the curve 177 and is equal to zero at the negative H-axis intercept, 183. The value of the magnetic field, H, at point 183 is known as the 'normal coercive force' or 'normal coercivity' of the material and is commonly represented by the symbol, $H_c$. Its value is another metric that is commonly used to specify ferromagnetic materials. As the applied field, H is decreased beyond the point 183, the magnetic induction takes on increasingly negative values and eventually saturates at the point 198. When the field is decreased beyond this point and subsequently increased, the induction, B, follows the lower branch 200 of the hysteresis curve 177 and eventually saturates in the positive direction at the point 187.

Figure 5:
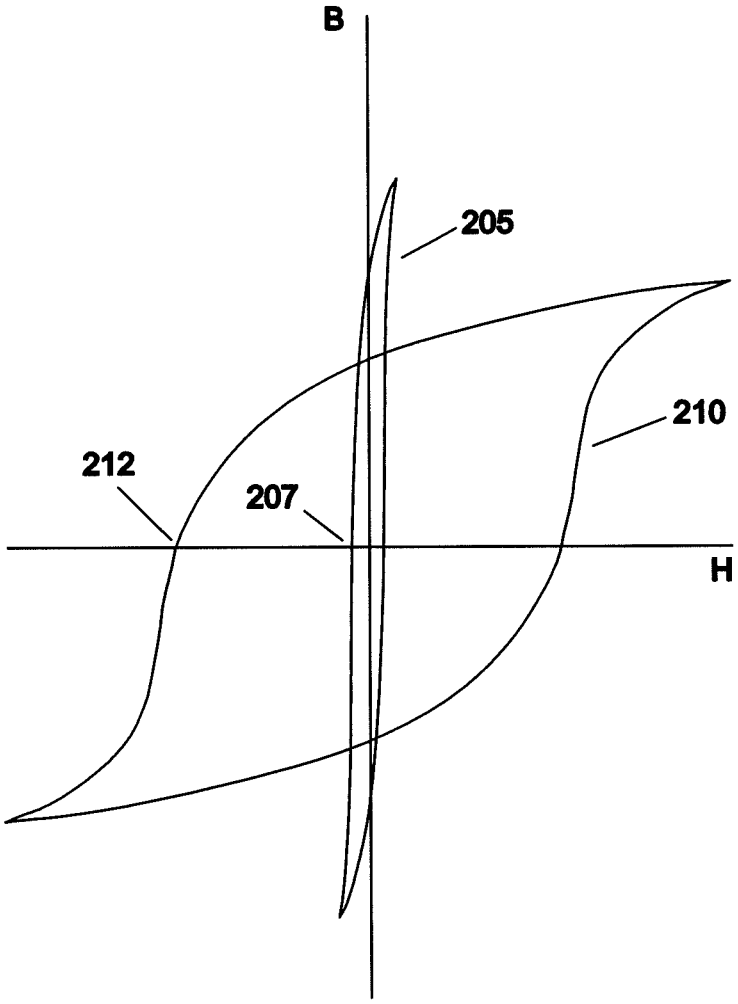
FIG. 5 is a two dimensional graph illustrating the qualitative difference in the shapes of the major hysteresis curves of hard and soft ferromagnetic materials.

The area enclosed by a hysteresis curve is a measure of the work that must be performed by the applied field as the magnetization of a material is cycled around the curve. Changing the direction of the magnetization in hard ferromagnetic materials is more difficult than in soft ferromagnetic materials and this difference is reflected in the comparatively large coercivity values and major hysteresis loop areas of the hard materials. FIG. 5 is a graph illustrating the qualitative differences in the shapes of the hysteresis curves for representative hard and soft ferromagnetic materials. The curve 205 is a representative major hysteresis curve of a soft material and has a comparatively small area and coercivity, 207. The curve 210 is a representative hysteresis curve of a hard material and has a significantly larger area and coercivity, 212.

The normal coercivity value may be used to differentiate hard and soft materials and, in the present application, soft ferromagnetic materials are defined as having normal coercivity values that are less than 100 Oersteds (Oe). Ferromagnetic properties that are typically specified for soft ferromagnetic materials include the initial permeability for an unmagnetized material in the presence of small, slowly varying magnetic fields and the field intensity at which the magnetization saturates. The variation of permeability with the strength and frequency of an external field may also be specified in addition to frequency-dependent loss coefficients.

Figure 6:
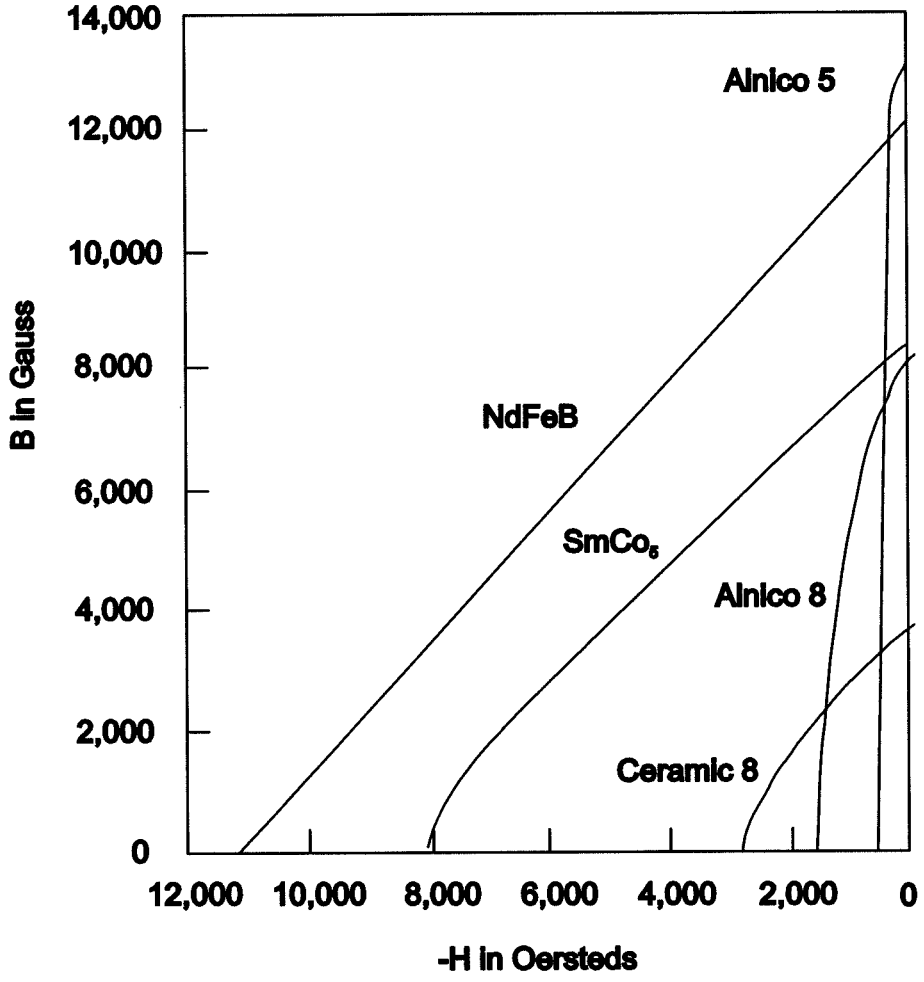
FIG. 6 is a two dimensional graph illustrating the demagnetization curves for several hard ferromagnetic materials.

As defined in the present application, hard ferromagnetic materials have normal coercivities that are greater than or equal to 100 Oe and hysteresis materials have normal coercivities in the range of 100 Oe to 1000 Oe. Hard ferromagnetic materials are typically used to make permanent magnets and hysteresis loss elements. Important ferromagnetic properties for these materials include remanence, coercivity, and conductivity in addition to the shape of the demagnetization curve and the maximum value for the product of induction and magnetic field. Hysteresis materials are a class of hard ferromagnetic materials with unique ferromagnetic loss properties that can advantageously affect the tone of magnetic pickups and speakers. FIG. 6 is a two dimensional graph, adapted from "Modern Permanent Magnets for Applications in Electro-Technology," by Karl J Strnat, *Proc. IEEE*, Vol. 78, pp. 923 (1990), that illustrates the demagnetization curves for representative hard ferromagnetic materials. Of the illustrated materials, Alnico 5 is the only material with a coercivity that falls within the hysteresis material range.

While major hysteresis curves and initial magnetization curves of the type illustrated in FIG. 3 are adequate for most DC and large signal applications, additional parameters are needed to describe the behavior of ferromagnetic materials that are subjected to small variations in the applied field. In a magnetic pickup, for example, the pole pieces are typically maintained at a fixed magnetic bias and the vibrating strings produce small, audio frequency perturbations in the bias field. Perturbations of this magnitude are not large enough to permanently reorient the domains in a pole piece but do cause them to move about their equilibrium orientation. The relationship between B and H under these conditions is described by a series of minor hysteresis curves that pass through points on the major hysteresis curve that correspond to the steady-state orientation of the domains.

Figure 7:
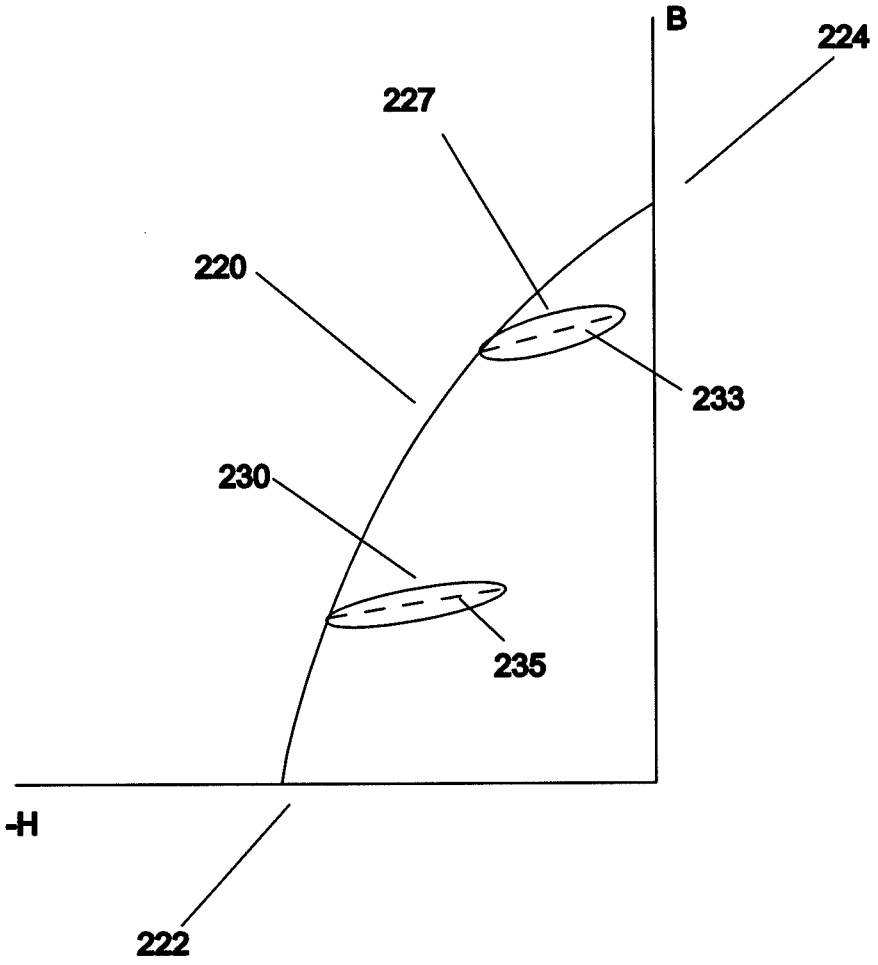
FIG. 7 is a two dimensional graph illustrating the demagnetization curve and representative recoil hysteresis loops for a hard ferromagnetic material.

FIG. 7 illustrates the demagnetization curve 220 and a set of minor hysteresis loops 227, 230 for a hard ferromagnetic material such as Alnico 3 that has been initially magnetized to saturation by the applied field. Minor loops in hard materials such as Alnico 3 are also known as recoil hysteresis loops. The coercivity, $H_c$, of the illustrated material is equal to the value of the applied field at the H-axis intercept 222 of the demagnetization curve 220 and the remanence, $B_r$, is equal to the value of the induction at the B-axis intercept, 224. The slopes of the major axes 233, 235 of the minor hysteresis loops 227,230 are equal to the recoil permeability values for the material at the corresponding bias field strength. The energy required to cycle the magnetization around a minor loop is known as the recoil hysteresis loss and is proportional to the minor loop area. In most materials, the recoil hysteresis loss increases with the magnitude of the magnetic field fluctuations.

In a magnetic pickup, the ferromagnetic components are subjected to DC bias fields and small, audio frequency fields with frequencies and magnitudes that are determined by the string vibrations. In a typical Stratocaster-style single coil pickup with fully-magnetized Alnico 5 pole pieces, for example, the magnetic induction at the pole ends has a bias value of approximately 1000 Gauss and the vibration of the ferromagnetic strings generate audio frequency perturbations in the bias field and the induction in the material that are described by recoil hysteresis loops. The energy expended in moving around the loops represents a loss to the system and the nonlinearity of the recoil process adds harmonics to the audio frequency spectrum of the string-induced field perturbations.

The small, time varying audio frequency fields in a magnetic pickup experience additional ferromagnetic losses that are caused by eddy currents in conductive materials that are permeated by the fields. Eddy current losses increase with the square of the field frequency and are approximately proportional to the magnitude of the magnetic field variations, the conductivity of the material, and the material dimensions.

Minor loop hysteresis and eddy current losses in the pole pieces, magnets and other components of a magnetic pickup typically have a significant effect on its tonal properties. Minor loop hysteresis typically generates harmonics of the string vibrational frequencies and eddy current losses decrease the high frequency components of the pickup output. The tonal properties of common pickup pole piece materials including Alnico alloys and low carbon steel are due, at least partially, to advantageous combinations of hysteresis and eddy current losses.

In pickup systems that embody the present invention, the tone of a magnetic pickup is partially determined by one or more ferromagnetic tone shapers that are magnetically coupled to the pickup but physically separated from it by a distance. Components within the tone shaper affect the tone of the pickup by at least one of two mechanisms:

1. Altering the magnetic field distribution of the magnetic circuit that comprises the pickup and strings, 2. Changing the ferromagnetic losses within the circuit.

Magnetic pickups with integral tone shaping loss elements and magnetic field modifiers have been described by the inventor in several U.S. utility patents. U.S. Pat. No. 8,969,701 ('701) issued on Mar. 3, 2015 and describes magnetic pickups that comprise secondary field modifying magnets. Embodiments of the '701 invention comprise one or more secondary magnets that are attached to a pickup to modify the shape of a pickup's magnetic window. In some cases, the secondary magnets are combined with dissimilar ferromagnetic materials in composite structures to couple additional ferromagnetic losses to the pickup. U.S. Pat. No. 8,907,199 ('199) that was granted to the inventor on Dec. 9, 2014 discloses magnetic pickups with self-magnetizing pole pieces and hard ferromagnetic backplates. U.S. Pat. No. 8,553,517 ('517) details the use of pickup components that are fabricated from low permeability materials that comprise granulated hysteresis materials or soft ferromagnetic materials in an insulating binder. '517 is a continuation-in-part of U.S. Pat. No. 8,415,551 that was granted to the inventor on Apr. 9, 2013. The teachings of U.S. Pat. No. 8,969,701, U.S. Pat. No. 8,553,517, U.S. Pat. No. 8,415,551 and U.S. Pat. No. 8,907,199 are hereby incorporated by reference in their entirety in the present application.

The single coil pickups 65, 66 and 67 that are mounted on the guitar 50 that is illustrated in FIG. 1 may have a conventional single coil design that comprises six cylindrically-shaped Alnico pole pieces and two endplates that are pressed onto the pole pieces to form a stable structure. A single wire coil is wound directly on the pole pieces and the two ends connected to wire leads that facilitates connection of the pickup to the control circuit 71. The single coil 65, 66, 67 pickups further include insulating covers that protect the coil from mechanical damage and improve the cosmetics of the guitar 50. 'Conventional' Stratocaster-style single coil pickups have been installed on guitars manufactured by Fender Musical Instrument Co. of Scottsdale, Ariz. since the initial market introduction of the Stratocaster model guitar in 1954. They are currently manufactured and sold as after-market modifications or installed as original equipment by Fender Musical Instrument Co. and other manufacturers.

When viewed along a line that passes through the center of each pole piece, the magnetic circuit that surrounds a conventional Stratocaster pickup is qualitatively similar in shape and extent to the magnetic circuit of the idealized single pole pickup that is illustrated in FIG. 2. In a direction that is parallel to the strings, a majority of the magnetic circuit falls within the volume defined by the sides of the pickup cover. The magnetic window of a pickup that is optimally mounted in a Stratocaster style guitar is, therefore, comparatively narrow in the direction of the strings and qualitatively similar to the magnetic window 80 of the pickup 67 that is illustrated in FIG. 1.

Figure 8:
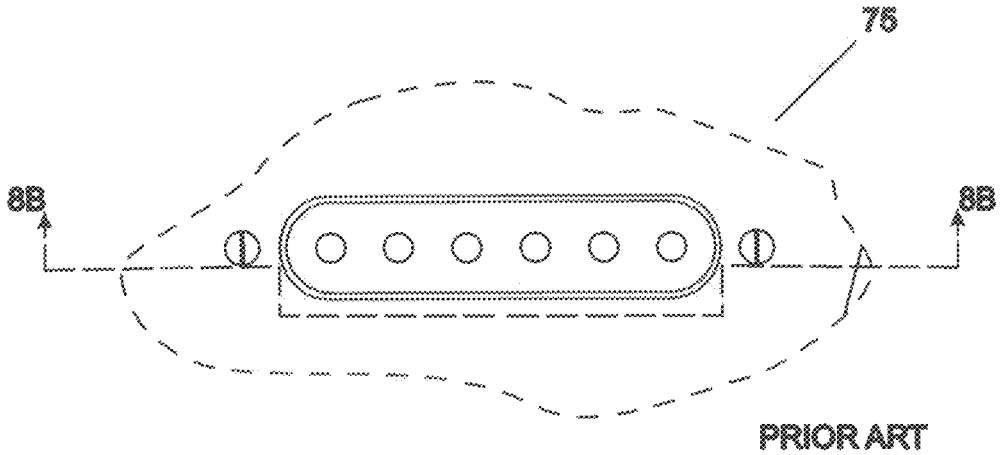
FIG. 8(A) is an orthographic top projection drawing of a conventional single coil pickup and the surrounding region of the pickguard of the Stratocaster-style guitar that is illustrated in FIG. 1.
FIG. 8(B) is a front sectional view of the conventional single coil pickup and the pickguard region taken along the line 8B-8B in FIG. 8(A).
Figure 8:
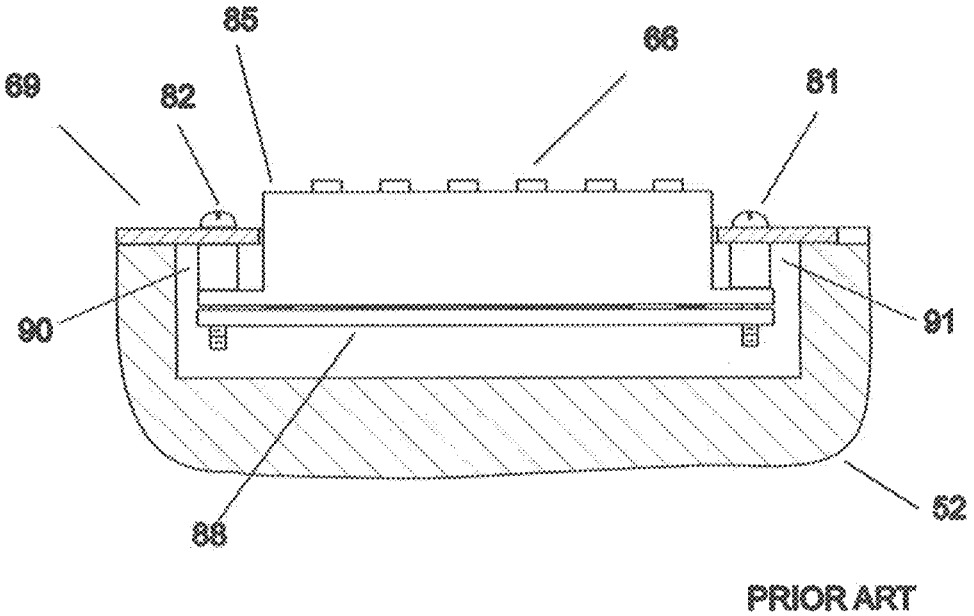

FIGS. 8(A) and 8(B) illustrate orthographic top and front sectional views of the pickup 66 and the region 75 that surrounds it. The section 8B-8B is taken on the side of the pickup nearest the bridge and is viewed in the direction of the bridge. For purposes of clarity, portions of the body 52 and the tremolo bridge 59 that lie below the pickup 66 are not illustrated in the front sectional view. The pickup 66 is attached to the pickguard 69 by machine screws 81, 82 that are threaded into the bottom plate 88 of the pickup 66. The machine screws 81, 82 pass through clearance holes in the pickguard 69 and the pickup cover 85 and, in the mounting configuration that is illustrated in FIGS. 8(A) and 8(B), lengths of rubber tubing 90, 91 that surround the screws 81, 82 are compressed between the pickup cover 85 and the pickguard 69. The compressed tubing stabilizes the assembly and allows the height and angle of the pickup 66 with respect to the upper surface of the pickguard 69 to be adjusted by rotating the screws 81, 82. In alternative mounting configurations, the lengths of rubber tubing 90, 91 may be replaced by springs or other conventional means of tensioning the screws.

The pickguard 69 of a typical Stratocaster-style guitar 50 is typically formed from one or more layers of an insulating plastic and attached to the guitar body 52 with wood screws. Stratocaster pickguards are typically 0.050 inches to 0.100 inches thick and conductive foils may be affixed to at least a portion of the lower surfaces of insulating plastic pickguards to partially shield the pickups and associated wires from electromagnetic interference (EMI). In alternative designs, the aluminum foil may be replaced by sheets of aluminum or other conductive materials and the pickguard 69 may be formed from alternative semi-rigid structural materials such as aluminum and wood The components of a musical instrument, such as the Stratocaster-style guitar 50 that is illustrated in FIG. 1, may be grouped according to their mechanical function. Components that stabilize or support other components and are key to the mechanical integrity of the instrument are said to have a structural support function and include the body 52, the pickguard 69, the bridge plate 59, bridge saddles 60, tremolo bar 61, the neck 51, including the nut 57 and frets 62, and the machine heads 55. Components of the Stratocaster-style guitar 50 that do not have a structural support function include the pickups 65, 66, 67, the switch 74, the tone potentiometers 79, the volume potentiometer 77, and the output jack 73. In the present application, components with a structural support function are referred to as 'structural components' and while those that do not are referred to as 'nonstructural components.'

Figure 9C:
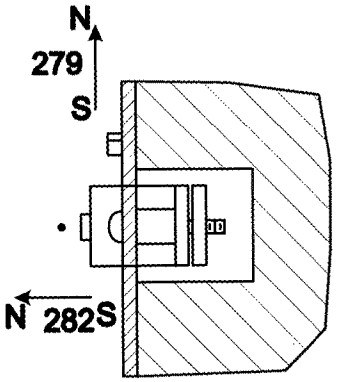
FIG. 9(C) is a side sectional view of the magnetic pickup system taken along the line 9C-9C in FIG. 9(A).
Figure 9A:
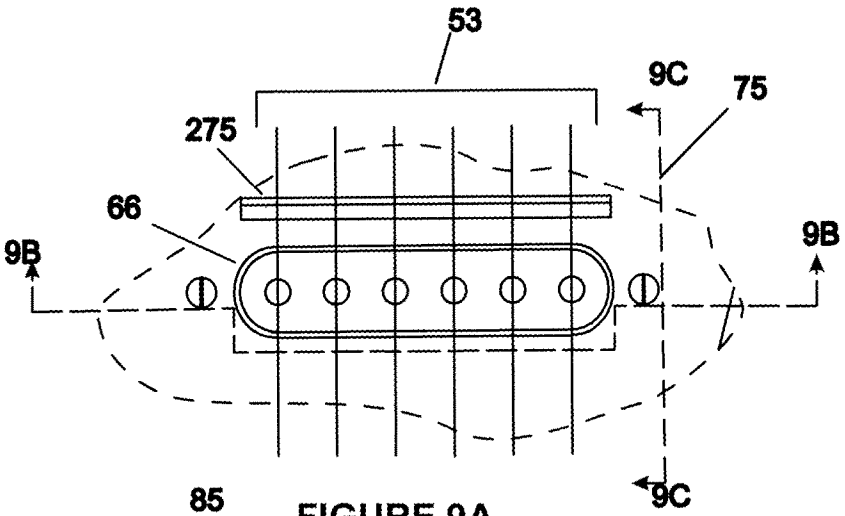
FIG. 9(A) is an orthographic top projection drawing of a magnetic pickup system that embodies the invention and comprises a conventional single coil pickup.
Figure 9B:
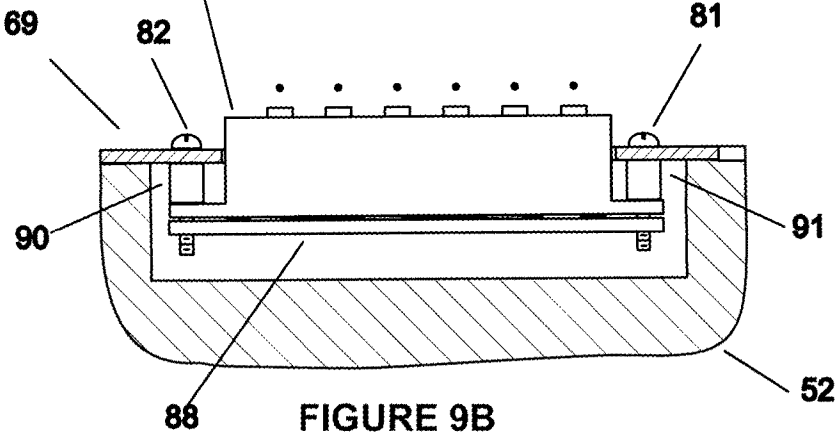
FIG. 9(B) is a front sectional view of the magnetic pickup system taken along the line 9B-9B in FIG. 9(A).

FIGS. 9(A)-9(C) is a sectioned orthographic projection drawing illustrating a magnetic pickup system that embodies the present invention. The inventive pickup system comprises the middle pickup 66 of the Stratocaster-style guitar 50 and a tone shaper 275 that is displaced from the side of the pickup 66 that is closest to the neck 51. The tone shaper 275 is not structurally supportive of other components and interacts magnetically with the pickup without physically contacting it. It affects the tone of the pickup by altering at least one of the magnetic field distribution and ferromagnetic losses of the magnetic circuit comprising the conventional single coil pickup 66 and the strings 53 of the guitar 50.

Figures 10A, 10B:
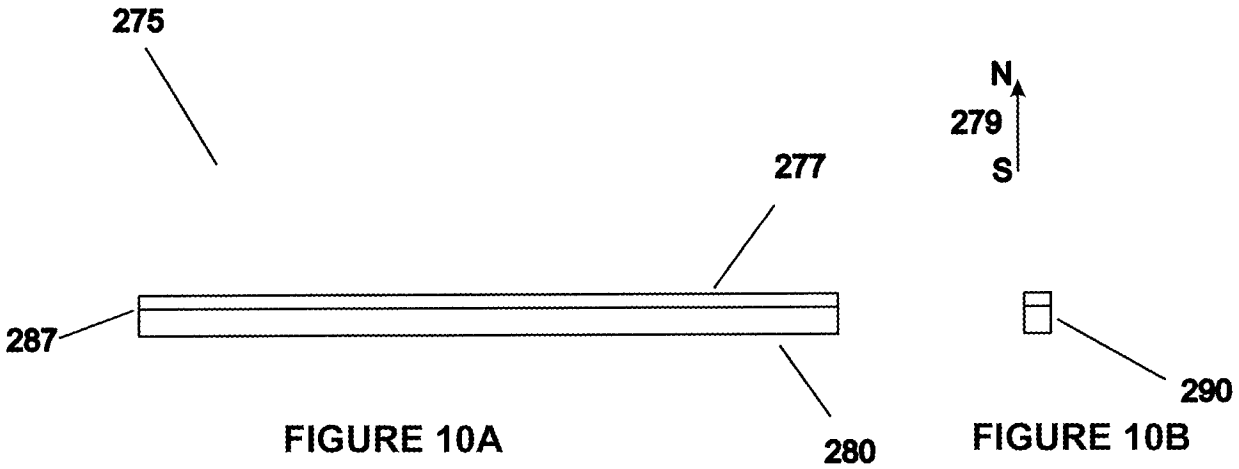
FIG. 10(A) is an orthographic top projection drawing of a hard ferromagnetic tone shaper.
FIG. 10(B) is a side view of the hard ferromagnetic tone shaper.

FIGS. 10(A) and 10(B) are orthographic top and side view drawings of an exemplary non-structural tone shaper 275 that comprises a strip of hard ferromagnetic material 277 that is magnetized in the direction and polarity of the arrow 279 and a mounting bar 280 that is fabricated from a non-ferromagnetic insulating material. The hard ferromagnetic strip 277 is approximately 0.060" thick in the direction of the magnetization arrow 279 and is formed from standard Ultramag bonded ceramic material that is manufactured by the Flexmag Division of Arnold Magnetics in Marietta, Ohio. The surfaces that are perpendicular to the magnetization direction are approximately 0.125" high and 2.75" long. The mounting bar 280 is a 2.75" long square rod of white polystyrene with side dimensions of 0.125". The magnetized hard ferromagnetic strip 277 is attached to the mounting bar 280 by a layer of cyanoacrylate cement 287 or other conventional adhesive. The surface 290 of the tone shaper 275 is attached to the pickguard 69 using a double-coated tape such as the 9628FL tape manufactured by 3M Corp. of St. Paul, Minn., an adhesive transfer tape, or a conventional adhesive.

In further embodiments of the invention, the hard ferromagnetic strip 277 may be formed from alternative hard ferromagnetic materials that include, but are not limited to, the materials commonly used to make bonded, ceramic, SmCo and NdB permanent magnets. Optionally, the dimensions of the hard ferromagnetic strip 277 may also be adjusted over wide ranges in order to achieve specific tonal and mechanical design objectives. The height of the strip 277 may, for example, may be decreased to prevent interference with a musician's pick motion. The hard ferromagnetic strip 277 may also be angled with respect to the side of the pickup 66, raised above the surface of the pickguard 69, or tilted with respect to the pickguard surface. In certain cases, raising or tilting the strip 277 with respect to the surface of the pickguard 69 may be accomplished by inserting a piece of nonferromagnetic insulating material between the pickguard 69 and the mounting bar 280.

The tone shaper 275 that is illustrated in FIGS. 10(A)-10(B), consists of a single magnetized piece of hard ferromagnetic material and primarily affects the tone of the magnetic pickup 66 by altering the area of the strings 59 over which the pickup 66 is able to sense vibrational string motion. The shape of the magnetic window generated by the pickup 66 and tone shaper 275 is determined, in part, by the spacing between the pickup 66 and tone shaper 275 and the angle between of the tone shaper 275 and pickup 66 in a plane that is approximately parallel to the surface of the pickguard 69.

In the pickup system that is illustrated in FIGS. 9(A)-10(B), the poles of the pickup are magnetized with the direction and polarization of the arrow 282 and the magnetization direction 279 of the tone shaper 275 is orthogonal to the magnetization direction of the poles. The influence of the tone shaper 275 on the tone of the pickup 66 decreases with the distance between the pickup 66 and the tone shaper 275 and, in the exemplary embodiment of FIGS. 9(A)-10(B) the distance between the side of the pickup 66 and the tone shaper 275 is approximately 0.188." In other embodiments, the optimal spacing for a specific pickup and tone shaper may be determined by applying a repositionable tape or adhesive to the surface 290 and listening to the effect of the tone shaper 275 on the tone of the pickup 66 as it is positioned at different distances from the pickup 66. The angle between the tone shaper 275 and the pickup 66 in a plane that is approximately parallel to the surface of the pickguard 69 may be similarly optimized. In a typical embodiment, the repositionable adhesive that is used to optimize the relative spacing and angle of the pickup 66 and tone shaper 275 is reinforced or replaced with permanent adhesive at the conclusion of the optimization process.

In the exemplary embodiment of FIGS. 9(A)-10(B), the support bar 280 is a square bar of polystyrene plastic but, in other embodiments, the support bar may have other shapes and be fabricated from a wide range of nonferromagnetic structural materials. For example, the surface of the bar to which the permanent magnet 277 is attached may have a curved shape or be tilted with respect to the opposite and adjacent surfaces.

The angle between the magnetization direction 279 of the tone shaper 275 and the magnetization direction 282 of the poles of the pickup 66 significantly affects the shape of the pickup's magnetic window. Tone modifiers with fields that are oriented orthogonally to the field generated by the pole pieces as illustrated in FIG. 9(A)-10(B) have been found to advantageously alter the tone of some Stratocaster-style single coil pickups. In alternative embodiments, the field direction 279 of the tone shaper 275 and the field direction 282 of the pickup pole pieces may range through any combination of azimuthal and zenith angles in a spherical coordinate space.

Figure 11B:
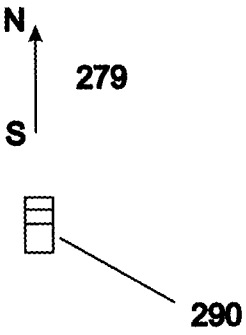
FIG. 11(B) is a side view of the composite ferromagnetic tone shaper.
Figure 11A:
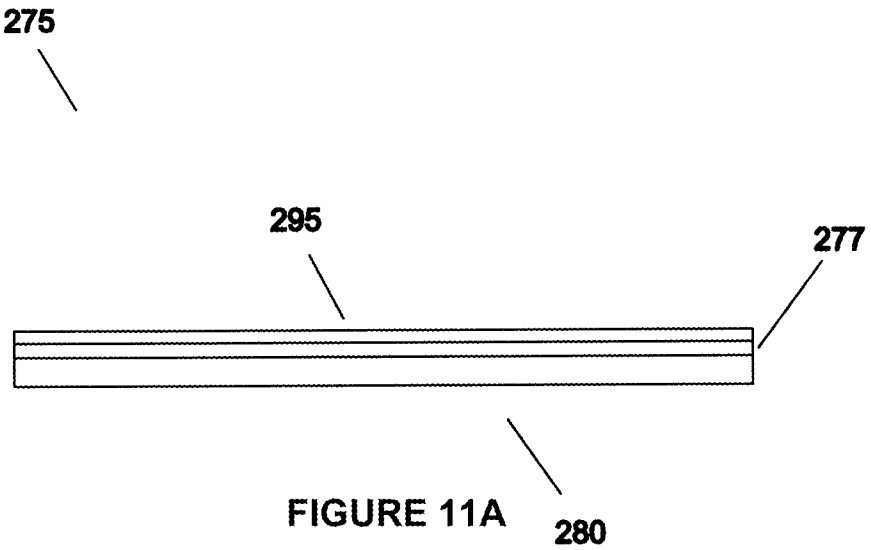
FIG. 11(A) is an orthographic top projection drawing of a composite ferromagnetic tone shaper.

In further embodiments of the invention, the nonstructural tone shaper 275 may have a composite structure that comprises two or more ferromagnetic components with different properties. FIGS. 11(A)-11(B) is an orthographic top and side view drawing that illustrates an exemplary composite design of the tone shaper 275 that is illustrated in FIG. 9(A)-9(C). In this design, a ferromagnetic loss element 295 is attached to the hard ferromagnetic tone modifier that is illustrated in FIGS. 10(A)-10(B). The mounting bar 280 and magnetized strip 277 are identical in size and composition to the similarly-numbered components of the tone shaper design that is illustrated in FIGS. 10(A)-10(B) and the loss element 295 is a 0.030" thick strip of granulated Alnico 3 that is incorporated in an initial volume percentage of 25% in the Polymer Medium product that is manufactured by Golden Artists Colors of New Berlin, N.Y. The strip 295 of insulator-bound Alnico 3 granules is magnetized in the direction of the arrow 279 before it is bonded to the hard ferromagnetic strip 277 with contact cement, double sided tape, transfer tape or an alternative conventional adhesive.

The composite tone shaper 275 that illustrated in FIGS. 11(A)-(B) affects the tone of the pickup 66 by reshaping the magnetic window of the pickup 66 and adding ferromagnetic losses to the magnetic circuit that comprises the pickup 66 and instrument strings 59. In the illustrated design, the magnetized hard ferromagnetic component 277 is primarily responsible for reshaping the magnetic window and the ferromagnetic losses are concentrated in the loss element 295. When the composite tone bar 275 is mounted approximately 0.187" from a Stratocaster-style single coil pickup 66 as illustrated in FIG. 9(A)-(C), vibrational motion of one or more of the strings 53 causes the flux to vary throughout the magnetic circuit that comprises the pickup 66, the strings 53 and the tone shaper 275. Ferromagnetic losses that result from string-induced flux variations in the loss element 295 are felt throughout the magnetic circuit and affect the tonal properties of the pickup 66.

In alternative embodiments, the loss element 295 may be formed from a wide range of different ferromagnetic materials. These include soft ferromagnetic materials, hysteresis materials such as the alloys of Alnico, FeCrCo and CuNiFe, and materials that comprise one or more granulated ferromagnetic materials and a binder. Depending on the desired level of eddy current losses in the element 295, materials that are used to bind granulated ferromagnetic materials may be insulating or conductive to varying degrees. The loss element 295 may further comprise nonferromagnetic conductors such as copper and aluminum. In certain cases, loss elements 295 that comprise bound granules or nonferromagnetic conductors may be sprayed, coated or painted directly on the magnetized hard ferromagnetic strip 277.

Materials that comprise granulated ferromagnetic materials and a binder may be manufactured by conventional methods. A number of suitable binding compounds, including epoxy resins, acrylic art media and polyurethane molding compounds, are supplied as viscous liquids that become solid through evaporative drying or through chemical reaction processes that proceed spontaneously or are facilitated by heat or UV light. Materials that incorporate binders of this type may be simply and economically produced by mixing ferromagnetic granules with the viscous binding material in the desired ratio, pouring the mixture into a mold or onto a flat surface and allowing it to harden. The bound Alnico 3 loss element 295 of the composite tone modifier 275, for example, may be manufactured by combining the Alnico 3 granules and the acrylic medium on a Teflon sheet and allowing it to dry in accordance with the manufacturer's instructions. Bound granulated materials may also be incorporated into thermoplastic and thermosetting binding materials and injection molded or extruded using methods that are commonly used in the production of commercial bonded permanent magnets.

In further embodiments, the components of a composite tone shaper may be assembled in different orders and orientations. For example, the loss element 295 may be directly attached to the bar 280 and the magnetized hard ferromagnetic strip 277 attached to the outside surface of the loss element 295 or, alternatively, the loss element 295 and the strip 277 may be mounted in direct contact with different sides of the mounting bar 280. In the latter case, the element 295 and strip 277 may be attached to opposite faces of the bar 280 or they may be mounted to adjacent faces that are orthogonally oriented.

Each of the ferromagnetic components 277, 295 of the composite tone shaper may also be angled with respect to the side of the pickup 66, raised above the surface of the pickguard 69, or tilted with respect to the pickguard surface. In certain cases, both components may be raised or tilted with respect to the surface of the pickguard 69 by inserting a piece of nonferromagnetic insulating material between the pickguard 69 and the mounting bar 280 and, in others, the components may be raised or tilted differently. In alternative embodiments, the bar 280 may be fabricated from the full range of nonferromagnetic materials with suitable structural properties and each of the surfaces of the bar 280 to which the ferromagnetic components are attached may be curved, tilted or shaped in a more complex fashion.

In the exemplary embodiment that is illustrated in FIGS. 11(A)-(B), the loss element 295 is magnetized prior to assembly and attached to the magnetized hard ferromagnetic strip 277 with its magnetization in the same direction 279 as the magnetization of the strip 277. In alternative embodiments, the loss element 295 may be unmagnetized, fully magnetized, or partially magnetized in any direction relative to the magnetization direction of the hard ferromagnetic strip 277 and the magnetization direction of the hard ferromagnetic strip 277 may be oriented at any combination of azimuthal and zenith polar angles with respect to the magnetization direction 282 of the pickup pole pieces.

In further embodiments, the mounting bar 280 may be eliminated from the designs that are illustrated in FIGS. 10(A)-11(B). In such cases, the magnetized hard ferromagnetic material 277 and any associated loss elements 295 are attached directly to the pickguard 69. In some designs, bound ferromagnetic granules and bonded ferromagnetic materials may be formed into mechanically stable shapes that can be mounted directly to a pickguard. In certain designs, the height of the components may be small enough that the direct attachment to a pickguard provides adequate stability.

Figure 12A:
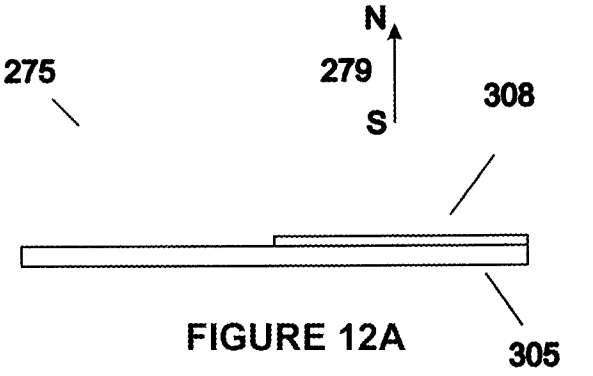
FIG. 12(A) is an orthographic top projection drawing of a hard ferromagnetic tone shaper that interacts differently with different magnetic pole pieces.

The designs of the nonstructural tone shaper 275 that are illustrated in FIGS. 10(A)-11(B) influence the output signals resulting from the vibration of each of the strings 53. FIGS. 12(A)-12(D) illustrate orthographic top views of alternative designs of the tone shaper 275 that influence the output signals generated by different groups of the strings 53 in different ways. FIG. 12(A), for example, illustrates a magnetic tone shaper 275 that comprises a mounting bar 305 and a strip of magnetized hard ferromagnetic material 308. When attached to the pickguard 69 approximately 0.125" from the edge of the pickup cover 66 as illustrated in FIG. 9(A)-9(C), the magnetic strip 308 preferentially alters the magnetic field distribution in the rightmost three of the strings 59. The hard ferromagnetic strip 308 is magnetized in the direction of the arrow 279 and is forming from standard Ultramag material that is approximately 0.060" thick in the direction of magnetization. In a plane that is orthogonal to the magnetization, it has a length of approximately 1.375" and height of 0.125". The mounting bar 305 is formed from a non-ferromagnetic insulator with a square cross section and 0.125" sides that is approximately 2.75" long. The strip 308 is attached to the mounting bar 305 using a conventional adhesive and positioned so that its rightmost end is approximately aligned with the right end of the bar 305.

Figure 12B:
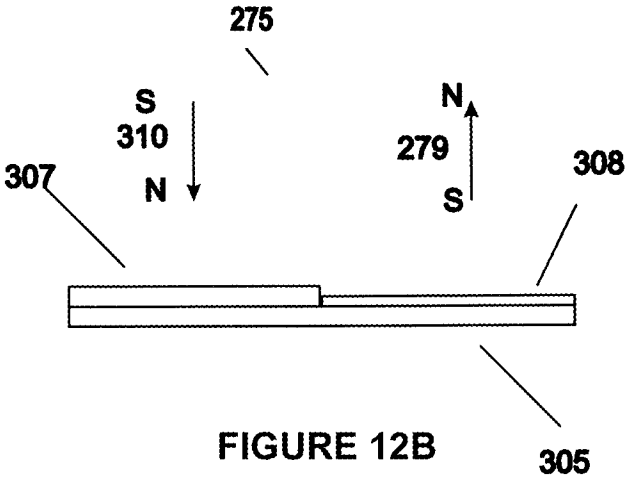
FIG. 12(B) is an orthographic top projection drawing of a tone shaper with two hard ferromagnetic components.

FIG. 12(B) illustrates an alternative design of the tone shaper 275 that comprises the mounting bar 305, the magnetized hard ferromagnetic strip 308 an additional magnetized hard ferromagnetic strip 307. The dimensions and magnetization of the strip 308 are the same as in FIG. 12(A). The hard ferromagnetic strip 307 is formed from standard UltraMag material and has the same length and height dimensions as the strip 302. The thickness of the strip 307, however, is approximately twice the thickness of the strip 308 and it is magnetized with the opposite magnetic polarity in the direction of the arrow 310. When attached to the pickguard 69 at a distance approximately 0.187" from the pickup 66 as illustrated in FIG. 9(A)-9(C), it modifies the magnetic field distributions in the leftmost three of the strings 53 and the rightmost three of the strings 53 in different ways. In analogy to the tone shaper designs of FIGS. 10(A)-10(B) and 12(A), the strips 307 and 308 may have varying thicknesses, including thicknesses that are approximately the same, and the height and/or thickness of at least one of the strips 307, 308 may be tapered. The magnetic field directions 310, 279 of each of the strips 307 and 308 may also take on any combination of azimuthal and zenith angles in a 3D polar coordinate system.

Figure 12C:
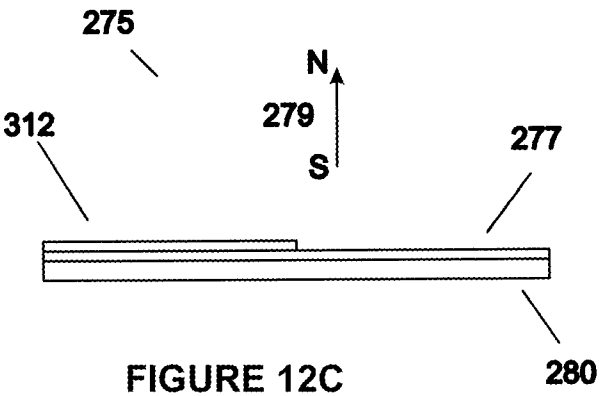
FIG. 12(C) is an orthographic top projection drawing of a composite tone shaper that interacts differently with different magnetic pole pieces.

FIG. 12(C) illustrates an alternative tone shaper design in which a half-length ferromagnetic loss element 312 is attached to the tone shaper 275 that is illustrated in FIG. 10(A)-10(B). The square polystyrene mounting bar 280 and Ultramag strip 277 have the same dimensions and magnetic field orientation as the components that are illustrated in FIG. 10(A)-10(B). The ferromagnetic loss element 312 is attached to the surface of the Ultramag strip 277 using a conventional tape or adhesive. In a representative embodiment, the loss element is fabricated from a 0.030" thick strip of granulated Alnico 2 that is incorporated in a flexible epoxy binder in the initial volume ratio of approximately 1:8. It has an approximate length of 1.375" and a height of 0.125". When mounted approximately 0.125" from the pickup 66 as illustrated in FIG. 9(A)-9(C), the tone shaper 275 that is illustrated in FIG. 12(C) adds the tonal qualities of the Alnico 2 material to the 3 strings with the highest output frequencies (the leftmost three of the strings 53 in FIG. 9(A)-9(C)). The tonal properties of the epoxy-bound Alnico 2 granules are dependent on the extent to which they have been oriented in an external magnetic field and the loss element 312 may be unmagnetized or magnetized to any degree before attaching it to the magnetic strip 277. In the embodiment that is illustrated in FIG. 12(C) the loss element 312 is fully magnetized and it is attached to the Ultramag strip 277 with its field parallel to the field of the strip as indicated by the arrow 279.

Figure 12D:
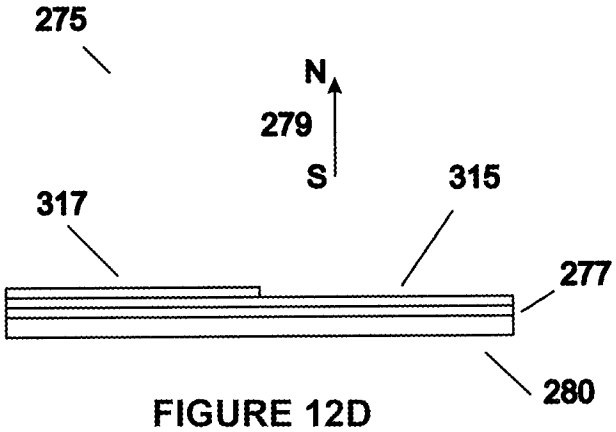
FIG. 12(D) is an orthographic top projection drawing of a composite tone shaper with three ferromagnetic components.

FIG. 12(D) illustrates another inventive tone bar 275 that comprises a mounting bar 280 and hard ferromagnetic strip 277 as illustrated in FIG. 10(A)-10(B) and two ferromagnetic loss elements 315, 317 with different ferromagnetic properties. The length and height of the loss element 315 are approximately equal to the length and height of the magnetic strip 277. The loss element 317 has a length that is approximately one half of the length of the magnetic strip 277 and a height that is approximately equal to that of the strip 277 and the loss element 315. When the tone shaper 275 that is illustrated in FIG. 12(D) is mounted to the pickguard 69 of a Stratocaster-style guitar as illustrated in FIG. 9(A)-9(C), the tones generated by all of the strings 53 are influenced by the magnet 277 and the loss element 315 while the loss element 317 principally affects the tone of the leftmost three of the strings 53. In a typical embodiment, the materials and dimensions of the mounting bar 280 and hard ferromagnetic strip 277 are the same as the components that are illustrated in FIG. 10(A)-10(B). The loss element 315 is a 0.005" thick piece of low carbon steel shimstock (typically 1010 or 1018 alloy) and the loss element 317 is a 0.020" thick piece of Arnochrome 3 as manufactured and sold by the Rolled Products Division of Arnold Magnetics in Marengo, Ill. The properties of the Arnochrome 3 are dependent on the orientation and magnetization state of the domains within it and, in the illustrated embodiment, the Arnochrome is unoriented and unmagnetized.

Further embodiments of the invention may have the qualitative design features of any of the nonstructural tone shapers that are illustrated in FIGS. 10(A)-12(D) but differ with respect to at least one of material composition, component dimensions, angular relationships with respect to the pickup and pickguard surface, and magnetic field orientation. For example, the magnetized hard ferromagnetic components 277, 308, 307 may be fully, partially or in homogeneously magnetized and fabricated from any hard ferromagnetic material. The ferromagnetic loss components 295, 312, 315 and 317 may similarly be fabricated from any ferromagnetic material or nonferromagnetic conductor with a desired set of ferromagnetic loss properties. The dimensions of any components, including the mounting bars 280,305, may be varied in arbitrary patterns along the thickness, height and length directions and the angles varied with respect to the side of the pickup 66 or the surface of the pickguard 69. One or more of the surfaces of the mounting bars 280, 305 may be curved or shaped in a more complex fashion to obtain a desired set of tonal properties. The separation of the tone shaper 275 with respect to the pickup may additionally be adjusted to optimize the tone of the pickup system for a specific application and the magnetic field direction of any magnetized component may be oriented at any azimuthal and zenith polar angle with respect to the magnetic field direction of the pickup pole pieces.

Figure 13:
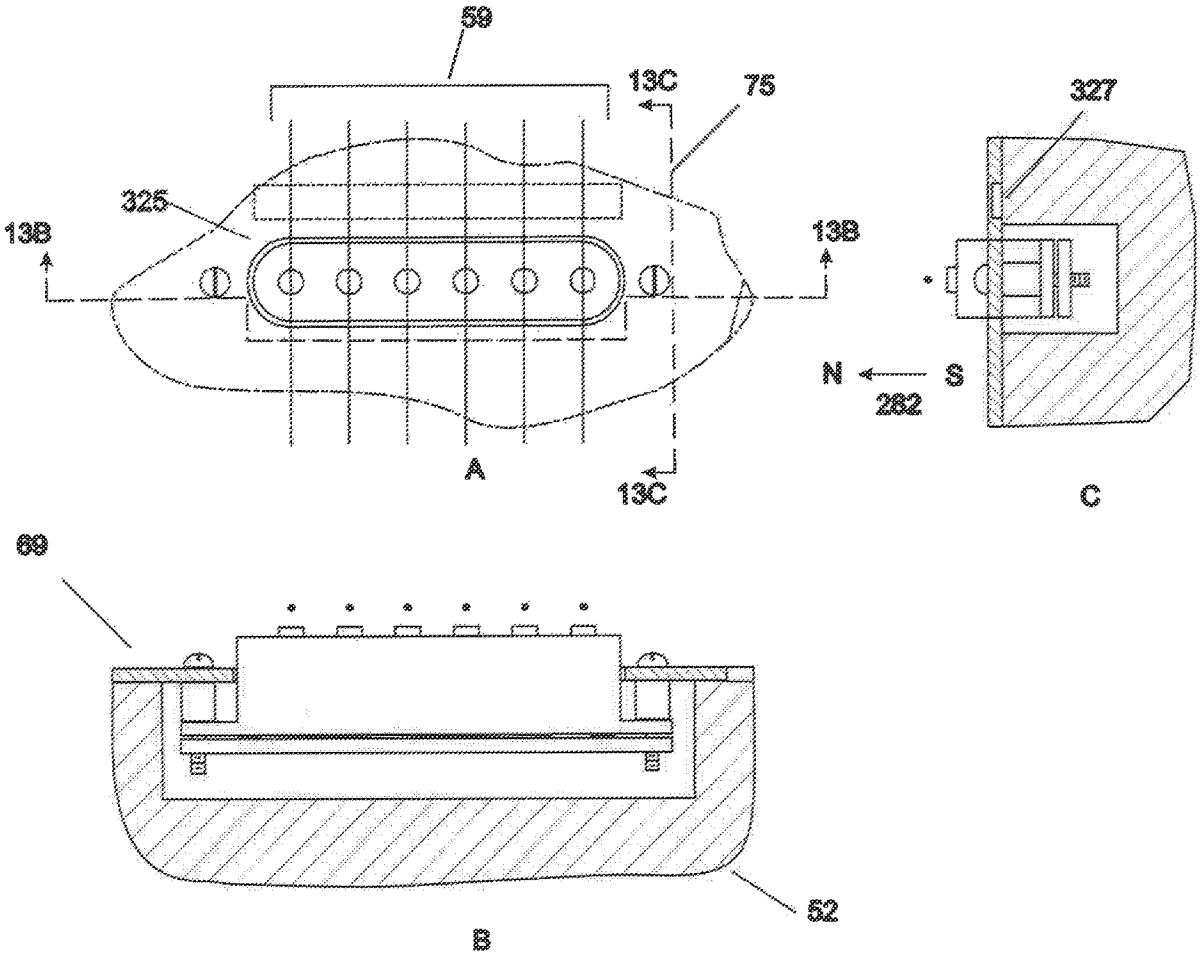
FIG. 13(A) is an orthographic top projection drawing of an inventive magnetic pickup system that comprises a noiseless single coil pickup and a ferromagnetic tone shaper.
FIG. 13(B) is a front sectional view of the inventive magnetic pickup system taken along the line 13B-13B in FIG. 13(A).
FIG. 13(C) is a side sectional view of the inventive magnetic pickup system taken along the line 13C-13C in FIG. 13(A).

The magnetic circuits of conventional Stratocaster-style single coil pickups, such as the Custom '69 and Original '57/'62 Strat Pickups that are manufactured by Fender Musical Instrument Co., of Scottsdale, Ariz., are spatially confined to a comparatively narrow volume around the magnetized pole pieces and the magnetized hard ferromagnetic components in the illustrated designs of the tone shaper 275 allow the shaper to have a significant tonal effect on the pickup without physically contacting it. Other pickups, however, have magnetic circuits that extend a significant distance beyond the pickup edges. These pickups include noiseless single coil pickups such as the L280-S pickups as manufactured by Bill Lawrence Guitar Designs of Orange, Calif., Samarium Cobalt Noiseless (SCN) single coil pickups as detailed in U.S. Pat. No. 7,227,076 ('076) that was issued to Willi L. Stich on Jun. 5, 2007 and p-90 pickups as described in U.S. Pat. No. 2,911,871 that was issued to C. F. Schultz on Nov. 10, 1959. FIGS. 13(A)-(C) illustrate a magnetic pickup system according to the present invention that comprises a Fender SCN noiseless pickup, as described in the '067 patent and installed as standard equipment on the American Deluxe Stratocaster guitars that were manufactured by Fender Musical Instrument Company from 2004-2009, and a tone modifier 327. The tone modifier 327 is formed from Alnico 4 granules in an insulating binder. Suitable binders include, but are not limited to, acrylic art media, epoxies and polyurethane mold-making compounds.

In the illustrated embodiment the pickup system is attached to the Stratocaster-style guitar 50 in the position of the conventional pickup 66 that is illustrated in FIG. 1. The nonstructural tone shaper 327 is embedded in a rectangular groove on the lower surface of the pickguard 69 and is not visible when the pickguard 69 and tone shaper 327 are attached to the guitar 50. The tone shaper 327 may be cut from a piece of solid material and attached to pickguard 69 with a conventional adhesive or, alternatively, it may comprise a granulated ferromagnetic material in a binder that is poured into the rectangular groove while the binder is in a liquid form.

The tone shaper 327 is approximately 2.75" long and 0.25" wide in a plane that is parallel to the bottom surface of the pickguard 69 and 0.030" thick in the orthogonal direction. It is essentially unmagnetized but, in alternative embodiments, may be partially or fully magnetized to optimize its tonal properties. The long edge of the tone shaper 327 that is closest to the SCN pickup 325 is approximately 0.125" from the pickup cover and approximately parallel to it.

In alternative embodiments, the nonstructural tone shaper 327 may have a composite structure comprising two or more dissimilar ferromagnetic materials or it may comprise a single piece of hard or soft ferromagnetic material. It may also be directly attached to the top surface of the pickguard 69 or to a mounting structure such as the mounting bar 280 that is illustrated in FIG. 11(A)-(B). The tone shaper 327 may additionally have one or more curved surfaces, various lengths, widths, and thickness and be singly or multiply tapered in any of these dimensions. It may also be positioned at various distances from the pickup 325 and be oriented at various angles with respect to the side of the pickup and the surface on which it is mounted.

In further embodiments of the invention, a magnetic pickup system may comprise a magnetic pickup and a tone shaper that comprises several ferromagnetic pieces. In some cases, the several ferromagnetic pieces may be fabricated from the same ferromagnetic material or at least two of the pieces may be fabricated from ferromagnetic materials with different properties.

Figure 14B:
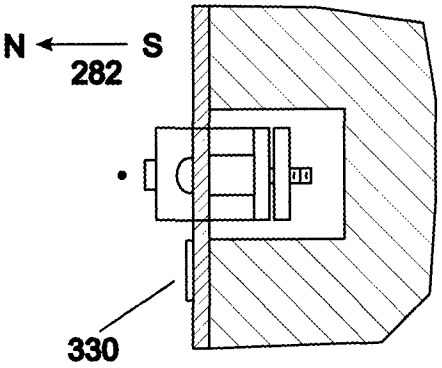
FIG. 14(B) is a side sectional view of the inventive magnetic pickup system that comprises a noiseless single coil pickup and a ferromagnetic tone shaper with multiple components taken along the line 14B-14B in FIG. 14(A).
Figure 14A:
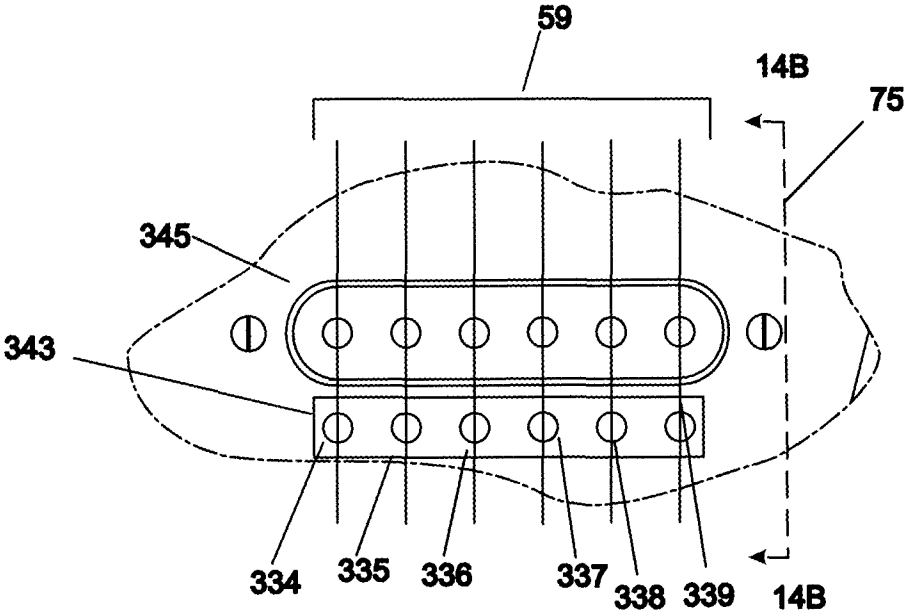
FIG. 14(A) is an orthographic top projection drawing of an inventive magnetic pickup system that comprises a noiseless single coil pickup and a ferromagnetic tone shaper with multiple components.

FIGS. 14(A)-(B) is a sectioned orthographic top and side view drawing illustrating a pickup system that is mounted in the position of the pickup 66 in the Stratocaster-style guitar 50 as illustrated in FIGS. 9(A)-9(C). The pickup system comprises a nonstructural tone shaper 330 with 6 ferromagnetic discs 334-339 and an L280 noiseless pickup 345 as manufactured by Bill Lawrence Guitar Design Co. of Orange, Calif. The tone shaper discs 334-339 are fabricated from Alnico 3 and are fully magnetized in the direction of arrow 282. Each of the discs 334-339 is approximately 0.030" thick, has an approximate diameter of 0.188 inches, and is securely mounted in a hole in the Forbon carrier 343 using Loctite 380 'BlackMax' cyanoacrylate adhesive or an alternative adhesive. The thickness of the Forbon carrier is approximately equal to the thickness of the Alnico 3 discs 334-339 and its upper surface is approximately 2.5" long and 0.44" wide. The Alnico discs 334-339 are spaced by a distance that closely matches the spacing of the poles of the pickup 345 and, in the embodiment that is illustrated in FIG. 14(A), the distance between the centers of adjacent discs is approximately 0.41." The edge of the carrier 343 is spaced approximately 0.125" from the pickup 345.

Figure 15A:
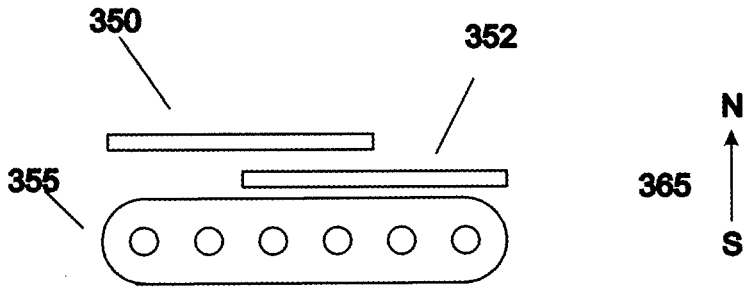
FIG. 15(A) is an orthographic top view drawing of an inventive magnetic pickup system that comprises a single coil pickup and two tone shaper components that are positioned on one side of the pickup to interact differently with different groups of pickup pole pieces.
Figure 15B:
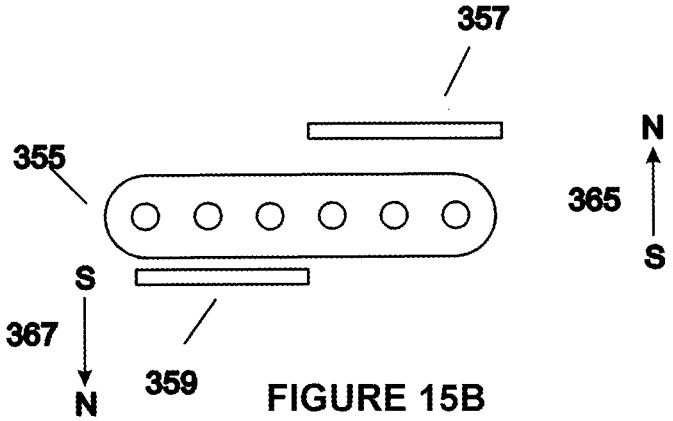
FIG. 15(B) is an orthographic top view drawing of an inventive magnetic pickup system that comprises a single coil pickup and two tone shaper components that are positioned on opposite sides of the pickup to interact with different groups of pickup pole pieces.
Figure 15C:
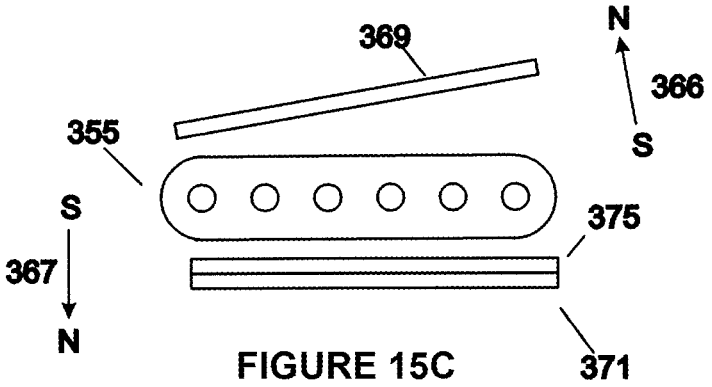
FIG. 15(C) is an orthographic top view drawing of an inventive magnetic pickup system that comprises a single coil pickup and a tone shaper with a component that is angled to differently affect each of the pickup pole pieces.

The tonal effect of a tone shaper is typically dependent on the direction in which it is displaced from a pickup. For example, the tone shaper 275 that is attached to the pickguard 69 on the side of the pickup 66 that is nearest the neck 51 of the Stratocaster-style guitar 50 as illustrated in FIG. 9(A)-9(C) will typically affect the tone of the pickup 66 differently if it is mounted at the same distance from the pickup 66 side that is nearest the bridge 59. Desirable tonal properties may, therefore, be obtained from pickup systems in which the tone shaper comprises multiple components that are mounted at different distances from one side of the pickup or on different sides. FIG. 15(A)-15(C) illustrates several pickup systems that comprise a single coil pickup 355 and tone shapers with two or more spatially-separated components.

FIG. 15(A) illustrates a nonstructural tone shaper embodiment in which two magnetized hard ferromagnetic components 350, 352 are mounted at different distances from the same side of the conventional Stratocaster style single coil pickup, 355. The components 350,352 are formed from a bonded NdB material and magnetized in the direction of the arrow 365. They are approximately 0.060 inches wide in the magnetization direction and 0.030 thick. Suitable bonded NdB materials are manufactured by a number of companies and include the Reance F65 material manufactured by The Electrodyne Corp. of Batavia, Ohio. FIG. 15(B) illustrates another tone shaper embodiment that comprises two magnetized hard ferromagnetic components 357, 359. The component 357 is magnetized in the direction of the arrow 365 and may, for example, be formed from a 0.090" wide strip of 0.060" thick standard Ultramag material and the component 359 is magnetized in the direction of the arrow 367 and may, for example, be formed from a 0.060" wide strip of 0.030" thick Reance F65.

FIG. 15(C) illustrates a further nonstructural tone shaper embodiment that comprises two magnetized hard ferromagnetic components 369, 371 and a ferromagnetic loss element 375 that is attached to the hard ferromagnetic component 371. The component 369 is angled at approximately 10 degrees with respect to the side of the single coil pickup, magnetized in the direction of the arrow 366 and is formed from 0.030" thick Reance F65. The hard ferromagnetic component 371 is magnetized in the direction of the arrow 367 and formed from standard 0.060" thick Ultramag material. The loss element 375 is formed from 0.060" thick Alnico 4 in an epoxy binder and attached to the hard ferromagnetic component 371 with a conventional adhesive.

In the embodiments that are illustrated in FIG. 15(A)-15(C), the ferromagnetic components are attached directly to the pickguard but may alternatively be attached to mounting bars that are fabricated from a nonferromagnetic structural material. Those skilled in the art of pickup design will realize that the spatial configurations and relative dimensions of the tone shaper components that are illustrated in FIG. 15(A)-15(C) are but a few of the many possible configurations in which multiple ferromagnetic components may be positioned to affect the tone of a conventional single coil pickup.

The embodiments that are illustrated in FIG. 1 and FIGS. 9(A)-15(C) are illustrative of the large number of ways that magnetic pickup systems that may be mounted on guitars with pickups that are attached to a pickguard. The illustrated pickup systems comprise conventional or noiseless Stratocaster-style single coil pickups but alternative pickguard-mounted embodiments may incorporate pickups with different designs that include, but are not limited to, Gibson-style humbucking pickups as described in U.S. Pat. No. 2,896,491 ('491) that was issued to S. E. Lover on Jul. 28, 1959, P90 pickups as described in U.S. Pat. No. 2,911,871 that was issued to C. F. Schultz, Filtertron-style humbucking pickups as described in U.S. Pat. No. 2,892,371 that was issued to J. R. Butts on Jun. 30, 1959, P-90 pickups, lipstick style pickups, rail pickups, alternative noiseless single coil pickups, and active pickups.

FIG. 16(A)-(C) illustrates a Les Paul-style guitar 400 that uses the pickup mounting rings 452,453 to secure two Gibson-style humbucking pickups 405,408 to the instrument body 412. In most respects, the operation of the Les Paul-style guitar 400 is similar to the operation of the Stratocaster-style guitar 50 that is illustrated in FIG. 1 but a shorter neck, different body and neck woods and humbucking pickups typically give Les Paul-style guitars a fuller, smoother tone and a greater output signal amplitude than Stratocaster-style guitars with conventional single-coil pickups. The ends of the strings 415 are anchored to the body 412 by a metal stop bar 418 and to the headstock 422 by adjustable machine heads 427. The strings vibrate between individually adjustable saddles on the bridge 424 and the nut 420 and a musician conventionally tunes the strings by pressing them against the frets on the neck 429. The output of the two Gibson-style humbucking pickups 405, 408 are routed to the output jack 442 through a control circuit that comprises four potentiometers 434, 437, 439 and 432 and the three-way switch 430. In a typical instrument, the output of the neck pickup 408 is routed through the volume control 432 and tone control 437 and the bridge pickup 405 is routed through the volume control 434 and tone control 439. The three-way switch 430 allows the volume and tone-controlled outputs of the two pickups to be connected individually or in parallel combination to the output jack 442. Components of the Les Paul-style guitar 400 that have a structural support function include the body 412, neck 429, frets 415, nut 422, headstock 422, machine heads 427, tailpiece 418, bridge 424 and pickup mounting rings 452,453. Nonstructural components include the switch 430, potentiometers 434,437,439 and 442 and the output jack 442.

Figure 16:
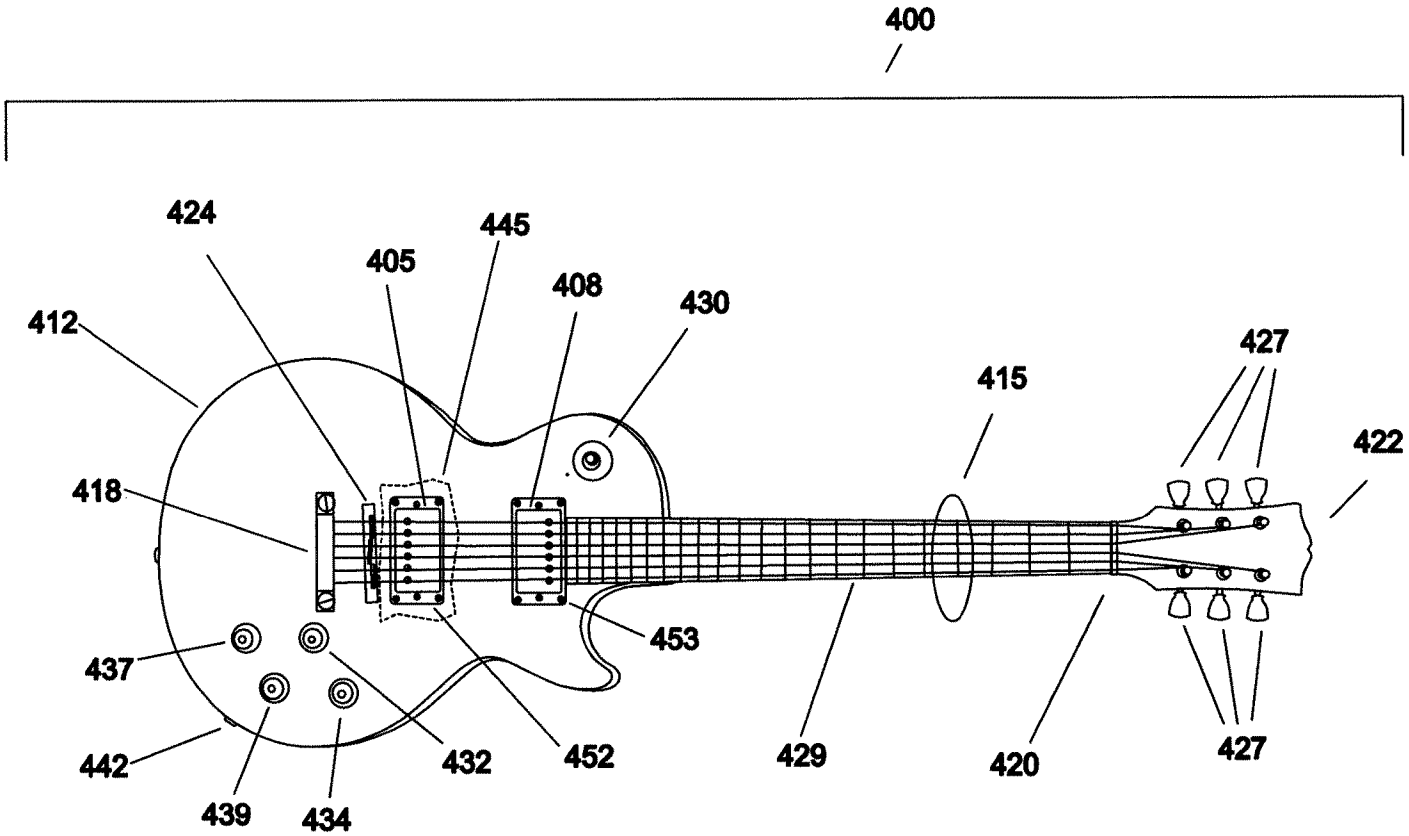
FIG. 16 is an orthographic top view drawing of a Les Paul-style guitar.
Figure 17C:
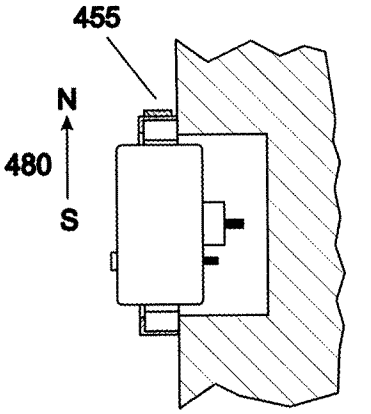
FIG. 17(C) is a side sectional view of the magnetic pickup system that is taken along the line 17C-17C.
Figure 17A:
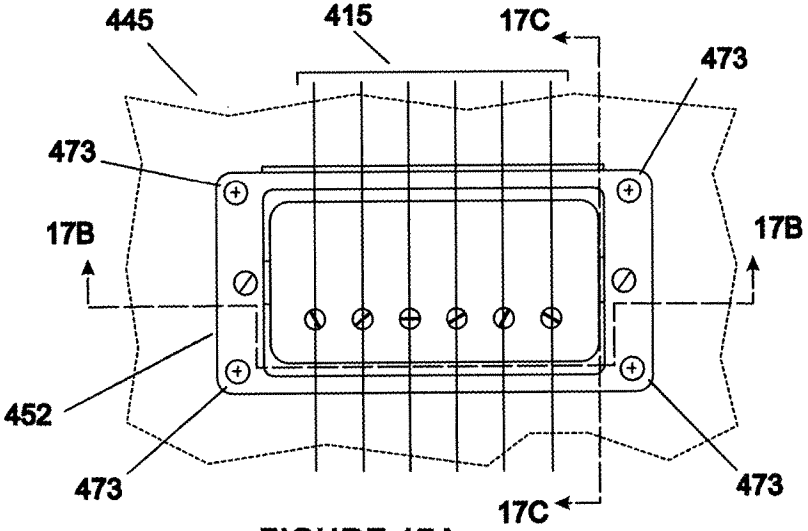
FIG. 17(A) is an orthographic top projection of a magnetic pickup system embodying the invention and comprising a humbucker pickup and a ferromagnetic tone shaper.
Figure 17B:
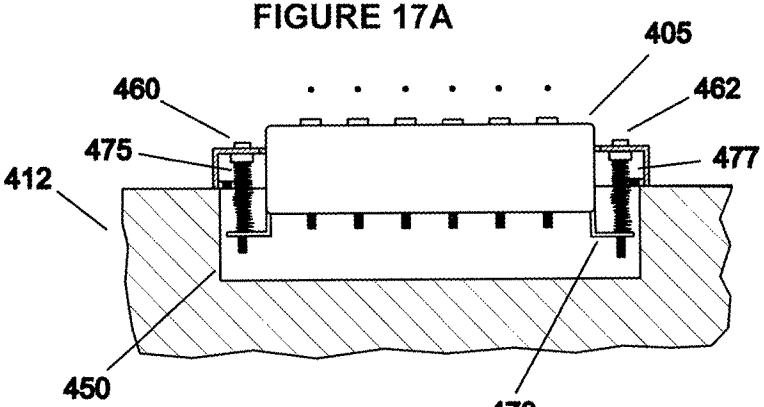
FIG. 17(B) is a front sectional view of the magnetic pickup system that is taken along the line 17B-17B.

FIGS. 17(A)-17(C) is a sectional orthographic projection drawing of a magnetic pickup system that further embodies the invention. The drawing of FIG. 17(A)-17(C) illustrates the region of the guitar 400 that is surrounded by the dotted line 445 in FIG. 16 and an inventive magnetic pickup system that comprises the humbucking pickup 405 and a ferromagnetic loss element 455. The pickup 405 is suspended from the pickup ring 452 in the recessed area 450 of the body 412 by two adjustment screws 460, 462 that pass through clearance holes in the pickup ring 452 and are threaded into the bracketed bottom plate 470 of the pickup 405. The pickup position is stabilized by compressed springs 475, 477 and the two sides of the pickup 405 are raised and lowered by turning the screws 460, 462. The pickup ring 452 is securely fastened to the body 412 by four screws 473.

The pickup rings that are used to mount humbucking pickups in conventional Les Paul guitars, such as the 2014 Les Paul Traditional that is manufactured by Gibson Guitar Corp. of Nashville, Tenn., are typically formed from an insulating plastic but aftermarket products may be forming from metal, wood or other rigid or semi-rigid structural materials. In different guitar designs pickup mounting rings may also have different shapes and dimensions, different numbers of adjustment and mounting screws, and, in certain cases, include electronic switching circuitry. The pickup rings that are used to mount Filtertron-style humbuckers on the G6120TV hollowbody guitar manufactured by Gretsch Guitars of Scottsdale, Ariz., for example, have different shapes and dimensions than the pickup rings on a Gibson Les Paul but perform the same mechanical function. Pickup rings with integral electronic switching circuitry include for example, the Triple Shot Pickup Mounting Rings that are manufactured by Carter Duncan Corp. (DBA Seymour Duncan) of Santa Barbara, Calif.

In the embodiment that is illustrated in FIGS. 17(A)-17(C), the tone shaper 455 is a 0.187" wide×2.875" long× 0.025" thick strip of insulator-bound Alnico 4 granules. The Alnico 4 granules are incorporated in a high solid acrylic art medium in the initial volume ratio of approximately 33% and magnetized in the direction of the arrow 480.

The magnetic circuits of humbucking pickups with the basic design features of the pickup that is disclosed in the '491 patent extend a short distance outside of the pickup cover in directions that are approximately perpendicular to the long sides of the pickup cover. Further embodiments of the tone shaper 455 may, therefore, solely consist of components that primarily function as ferromagnetic loss elements and do not generate appreciable magnetic field or they may comprise magnetized hard ferromagnetic components. In various embodiments of the invention the tone shaper 455 may comprise a hard ferromagnetic material, a soft ferromagnetic material, or a material that comprises at least one granulated ferromagnetic material and a binder. In others, the tone shaper may have a composite structure that comprises two ferromagnetic components with different ferromagnetic material properties. The components of a composite tone shaper may be joined together as illustrated in FIG. 11(A)-12(D), or they may be attached to the pickup ring or to the body 412 of the guitar in different locations.

Figure 18B:
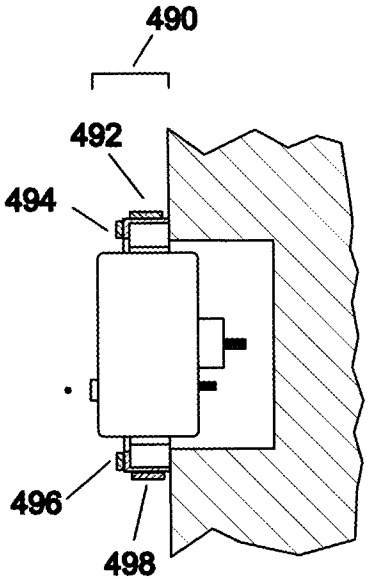
FIG. 18(B) is a side sectional view of the magnetic pickup system that is taken along the line 18B-18B.
Figure 18A:
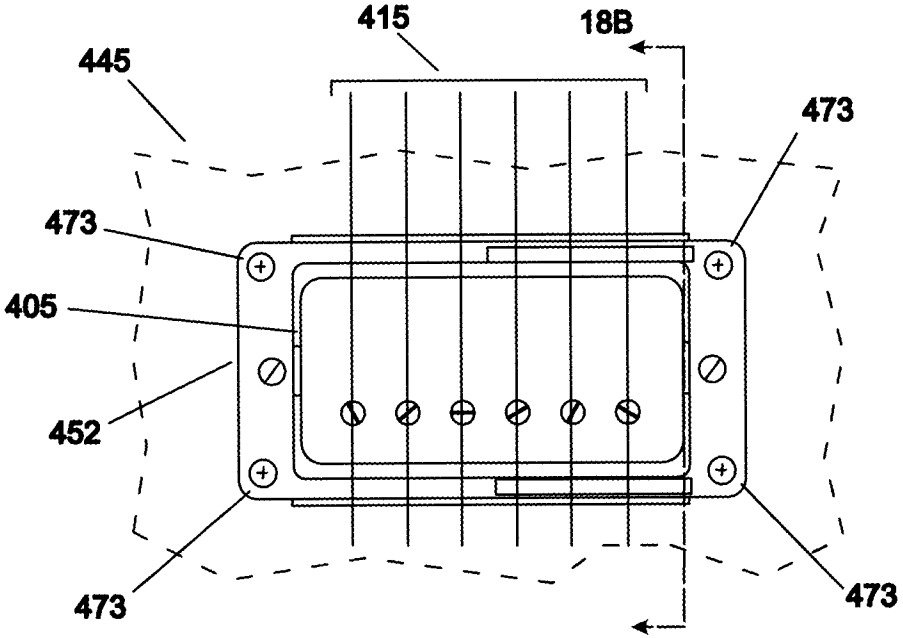
FIG. 18(A) is an orthographic top projection drawing of a magnetic pickup system embodying the invention that comprises a humbucker pickup and a ferromagnetic tone shaper with spatially separated components.

FIGS. 18(A)-18(B), for example, illustrate a composite tone shaper 490 with four components 492, 494, 496 and 498 that are mounted in different locations on the pickup ring 452. In the illustrated embodiment the components 492, 494, 496 and 498 are monolithic strips with approximately rectangular cross sections that are formed from nongranular ferromagnetic materials or materials that comprise a granulated ferromagnetic material and an insulating binder. The strips 494, 496 that are mounted to the top surface of the pickup ring 452 interact primarily with the rightmost three of the strings 415 and the strips 492, 498 that are mounted on the sides of the ring interact with all of the strings 415. Alternative tone shapers may comprise different numbers of components with different shapes, thicknesses and tapers or components that have composite structures.

Figure 19B:
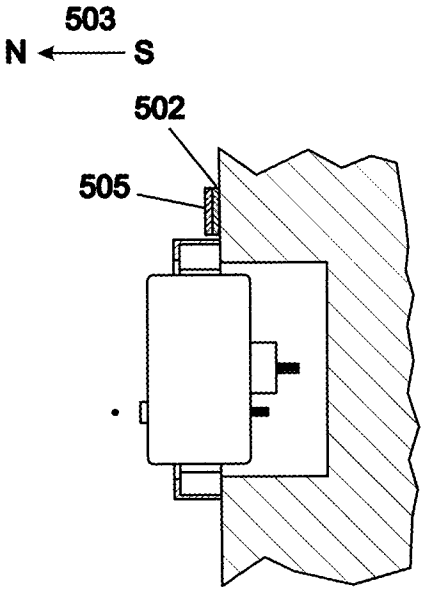
FIG. 19(B) is a side sectional view of the magnetic pickup system that is taken along the line 19B-19B.
Figure 19A:
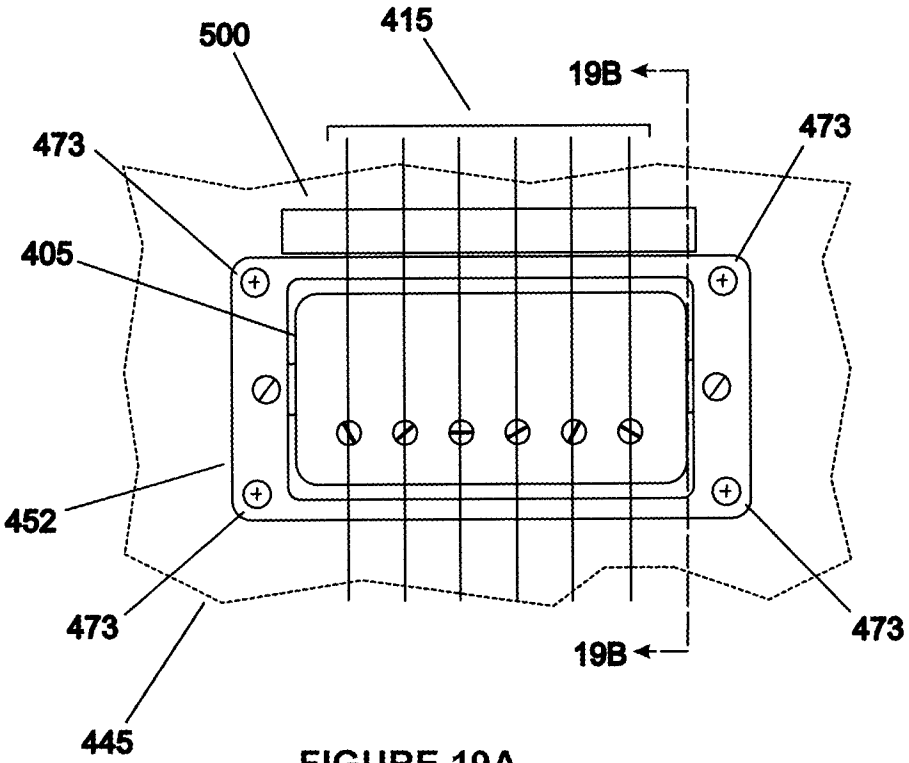
FIG. 19(A) is an orthographic top projection drawing of a magnetic pickup system embodying the invention that comprises a humbucker pickup and a composite ferromagnetic tone shaper.

FIGS. 19(A)-19(B) illustrates a composite tone shaper 500 that is attached directly to the body 412 with a conventional tape or adhesive. The tone shaper 500 is not structurally supportive of other components and comprises a magnetized hard ferromagnetic strip 502 and a loss element 505 that are joined together with a conventional adhesive. In the illustrated embodiment the hard ferromagnetic strip 502 is magnetized in the direction of the arrow 503. Advantageously, both components of the tone shaper 500 are formed from flexible materials that may be bent to match the contour of the body 412.

Figure 20:
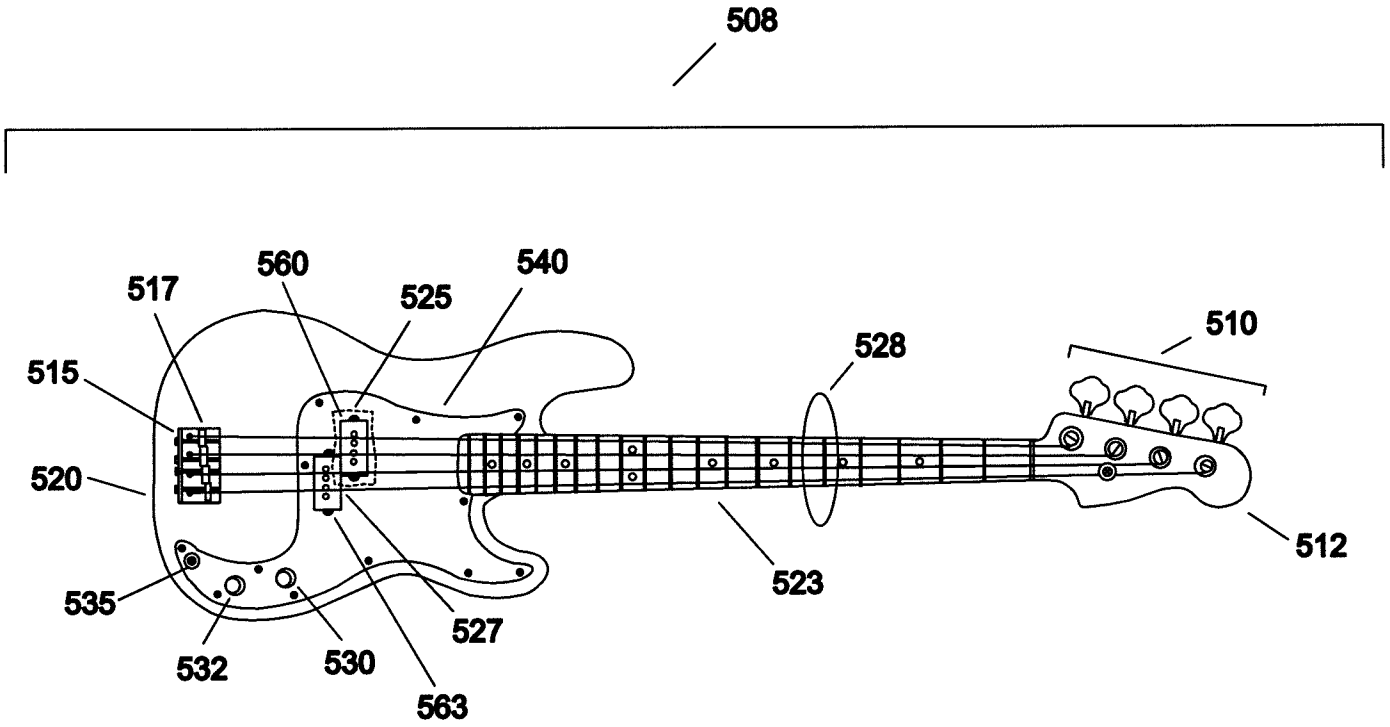
FIG. 20 is an orthographic top projection drawing of a Precision-style bass guitar.

In further embodiments of the invention, one or more components of a nonstructural tone shaper may be attached to an inner surface of a pickup ring, such as the pickup ring 452 that is illustrated in FIG. 16 and FIGS. 17(A)-(C). Nonstructural tone shaper components may also be embedded in a grooved or recessed portion of a pickup ring, and embedded structures may be attached to the pickup ring using conventional adhesives. Bound granular materials may also be poured into a groove or recess and allowed to harden in place or they may be painted or coated on portions of a pickup ring's internal and external surfaces. Pickup rings may also be formed entirely from bound structural materials with appropriate mechanical properties. Bound ferromagnetic pickup rings support the pickups that are attached to them and are, therefore, structural components of the guitar to which they are attached. FIG. 20 illustrates a Precision Bass (P-Bass) guitar 508 that is representative of instruments with pickups that are mounted directly on the instrument body. The basic operating principles of the P-Bass that is illustrated in FIG. 20 are similar to the operating principles of the single-coil equipped Stratocaster 50 that is illustrated in FIG. 1 but the diameter and number of strings, output frequency range and pickup design are different. The P-Bass 508 comprises a set of four strings 528 that are attached to machine heads 510 on the headstock 512, pass over a bridge plate 515 with adjustable saddles 517 and are anchored on the backside of the body 520 by a set of metal ferrules. In the instrument that is illustrated in FIG. 20 the neck 523 has conventional frets that enable a musician to change the vibrational frequencies of the strings in half-note steps but, in alternative designs, the neck may be fretless.

The pickup 527 has a split humbucking design as described in U.S. Pat. No. 2,976,755 ('755) that was issued to Clarence L. Fender on Mar. 28, 1961. It comprises two mechanically-independent, single-coil components 560,563 that each sense different sets of two strings. In the illustration of FIG. 20 the rightmost single coil pickup component 560 is surrounded by a dotted line 525 and senses the motion of the two strings with the largest diameters and lowest frequencies. The leftmost single coil pickup component 563 senses the motion of the two strings with the highest frequencies. The polarities and winding directions of the two single coil components that comprise a conventional P-Bass pickup are opposite and they are typically connected in series. Other pickups with a split humbucking design include, but are not limited to, the Z-coil pickups that are manufactured by G&L Guitars and installed as standard equipment on Comanche model instruments, the Jazz Ultra-bass pickup that is manufactured by Dimarzio, Inc. of Staten Island, N.Y., and the Split Blade Stratocaster pickups that are manufactured by Fralin Pickups of Richmond, Va. Pickups with this design are inherently noise-cancelling and significantly reduce the effects of electromagnetic interference (EMI) on the output signal.

In the P-bass guitar 508 that is illustrated in FIG. 20, the output signal from the split coil pickup is routed through a volume potentiometer 530 and tone potentiometer 532 to an output jack 535 that is used to connect the instrument to a DI box, amplifier or other musical electronic device. The control potentiometers 530, 532 and the output jack 535 are mounted on a pickguard 540 that is attached to the body 520 with several screws but, in contrast to the Stratocaster-design guitar 50 that is illustrated in FIG. 1, the pickups are secured to the body.

Figure 21A:
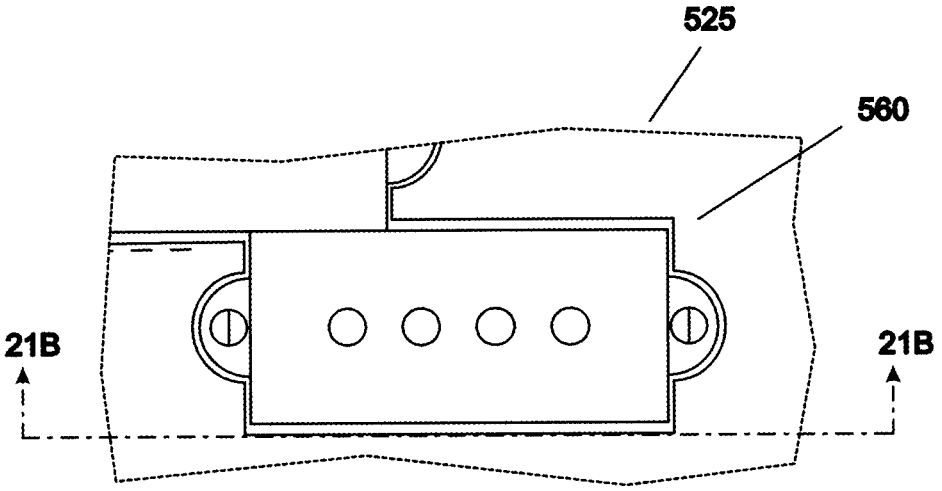
FIG. 21(A) is an orthographic top projection drawing of a portion of a P-bass pickup and a region of the surrounding pickguard.
Figure 21B:
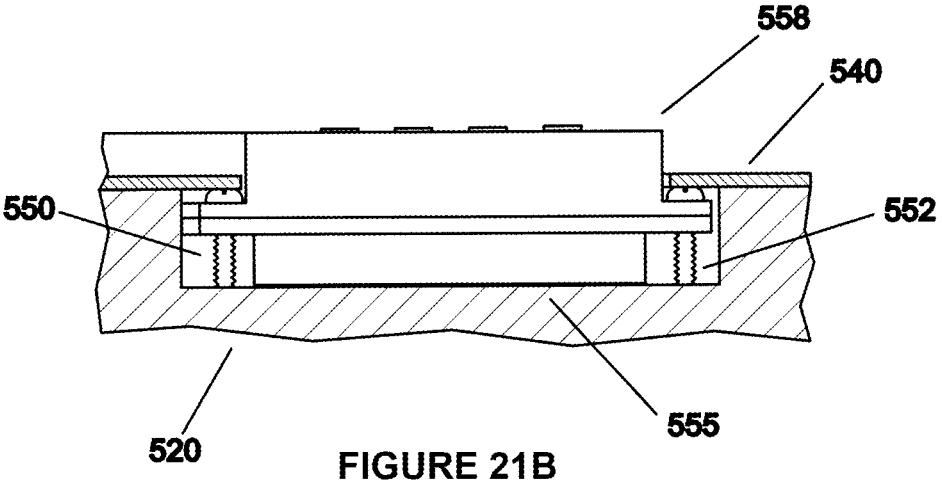
FIG. 21(B) is a front sectional view of the P-bass pickup portion and pickguard region taken along the line 21B-21B.

FIG. 21(A)-21(B) is a sectional orthographic drawing of the rightmost component 560 of the pickup 527 and the region of the P-Bass guitar 500 that is surrounded by the dotted line 525. The section 21B-21B is taken on the side of the pickup 527 that is nearest the neck 523. As described in '755, each component of the pickup 527 comprises a set of pole pieces that are mechanically stabilized and supported by upper and lower insulating plates that are conventionally formed from Forbon, a coil that is wound around the pole pieces, and a cover that is commonly formed from an insulating plastic or similar material. As illustrated in FIG. 21(A)-21(B), the component 560 of the pickup 527 is secured to the body 520 of the P-Bass 508 by two screws 550, 552 that pass through the pickup cover 558 and lower fibrous plate and into the body 520. The pickguard 540 typically surrounds the pickup 527 but is routed so that it does not make contact with it. The pickup component 560 is supported by a foam block 555 that is compressed between the body 520 and the pickup component 560. In alternative body-mount configurations the foam block may be replaced by compressed lengths of rubber tubing or by springs that surround the screws 552, 550. Components of the P-Bass guitar 508 that provide structural support to other components include the body 520, neck 523, frets 508, headstock 512, machine heads 510, bridge plate 515 and saddles 517. Nonstructural components include the pickguard 540, the pickup 527, the volume potentiometer 530, the tone potentiometer 532, and the output jack 535.

The body mounting technique is commonly used to attach P-bass and jazz-style pickups to bass guitars and is also used by certain manufacturers, including Ernie Ball Music Man, San Luis Obispo, Calif. and Jackson Guitars of Scottsdale, Ariz., to mount single coil and humbucking pickups to solid body guitars of the type illustrated in FIG. 1 and FIG. 16.

Figure 22B:
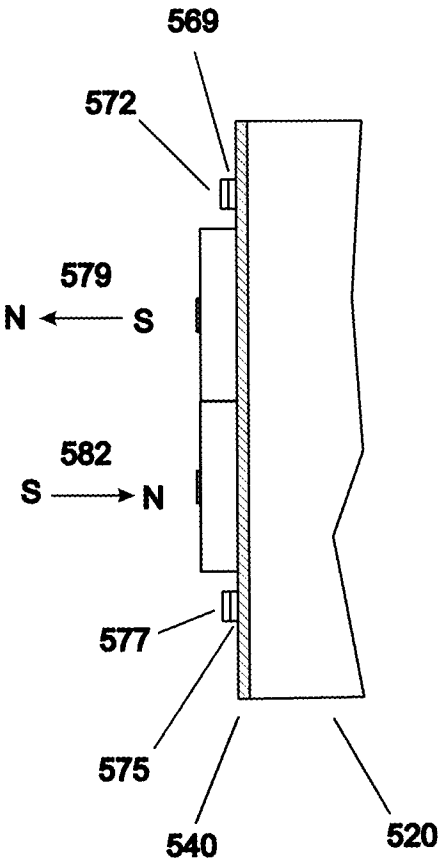
FIG. 22(B) is an orthographic side view drawing of the P-bass pickup and ferromagnetic tone shaper.
Figure 22A:
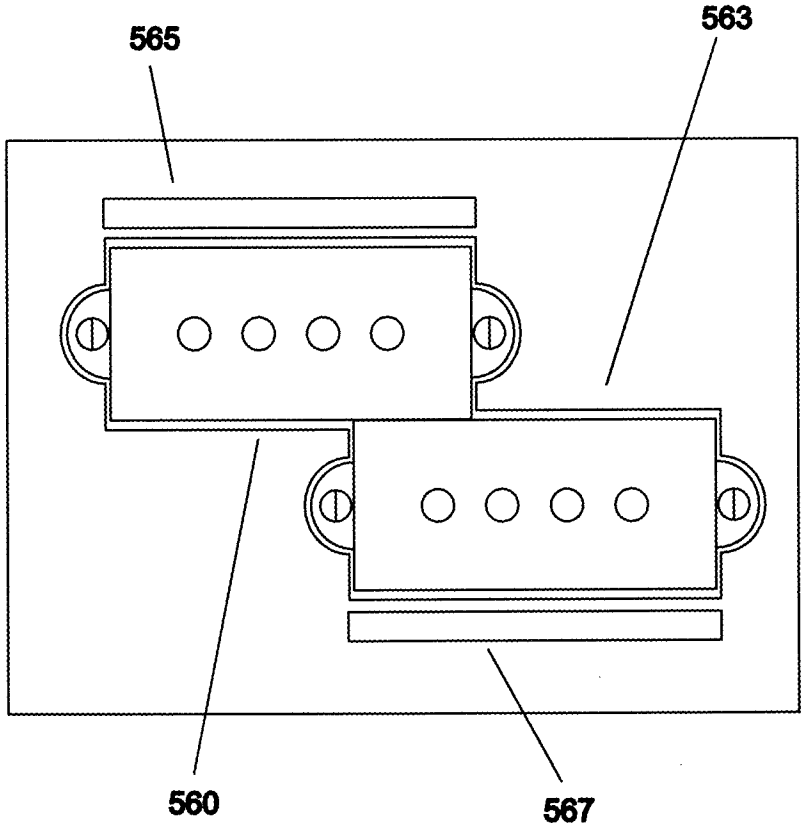
FIG. 22(A) is an orthographic top view drawing of an embodiment of the invention that comprises a P-bass pickup and a ferromagnetic tone shaper.

FIGS. 22(A)-22(B) illustrates a magnetic pickup system embodying the present invention that comprises the two single coil halves 560, 563 of the P-bass pickup 527 as illustrated in FIGS. 20-21(B) and a nonstructural tone shaper with two composite components 565, 567. The tone shaper components have approximately identical structures and comprise magnetized hard ferromagnetic strips 569, 575 and ferromagnetic loss elements 572, 577. In the embodiment that is illustrated in FIGS. 22(A)-22(B), the hard ferromagnetic strips, 569, 575 are 0.060" thick strips of Reance 65 with rectangular surfaces that are 2.5" long and 0.25" wide. The hard ferromagnetic strip 569 is magnetized in the same direction as the magnetization direction of the poles in the pickup component 560 as indicated by the arrow 579 and hard ferromagnetic strip 575 is oriented in the opposite direction as indicated by the arrow 582. The bottom surfaces of the strips 569, 575 are attached to the pickguard 540 using a conventional tape or adhesive. The loss elements 572, 577 are approximately 0.025" thick and have the same surface dimensions as the hard ferromagnetic strips 569, 575. The loss elements 572, 577 are formed from iron filings that are incorporated in a flexible epoxy binder at an initial volume ratio of 12.5% and are attached to the upper surfaces of the strips 569, 575 with a conventional tape or adhesive.

In further embodiments, the nonstructural tone shapers in pickup systems that comprise split humbucking pickups may comprise different numbers of monolithic or composite components with various shapes, magnetic field orientations and tapers that are arranged in different design configurations. P-bass pickups with designs that are similar to the design of the pickup 527 have comparatively narrow magnetic windows and typically benefit from tone shapers that include magnetized hard ferromagnetic components such as those illustrated in FIGS. 10(A)-15(C). Split coil pickups with wider magnetic windows may additionally benefit from tone shapers with loss elements that do not significantly modify the pickup's magnetic window.

Figure 23:
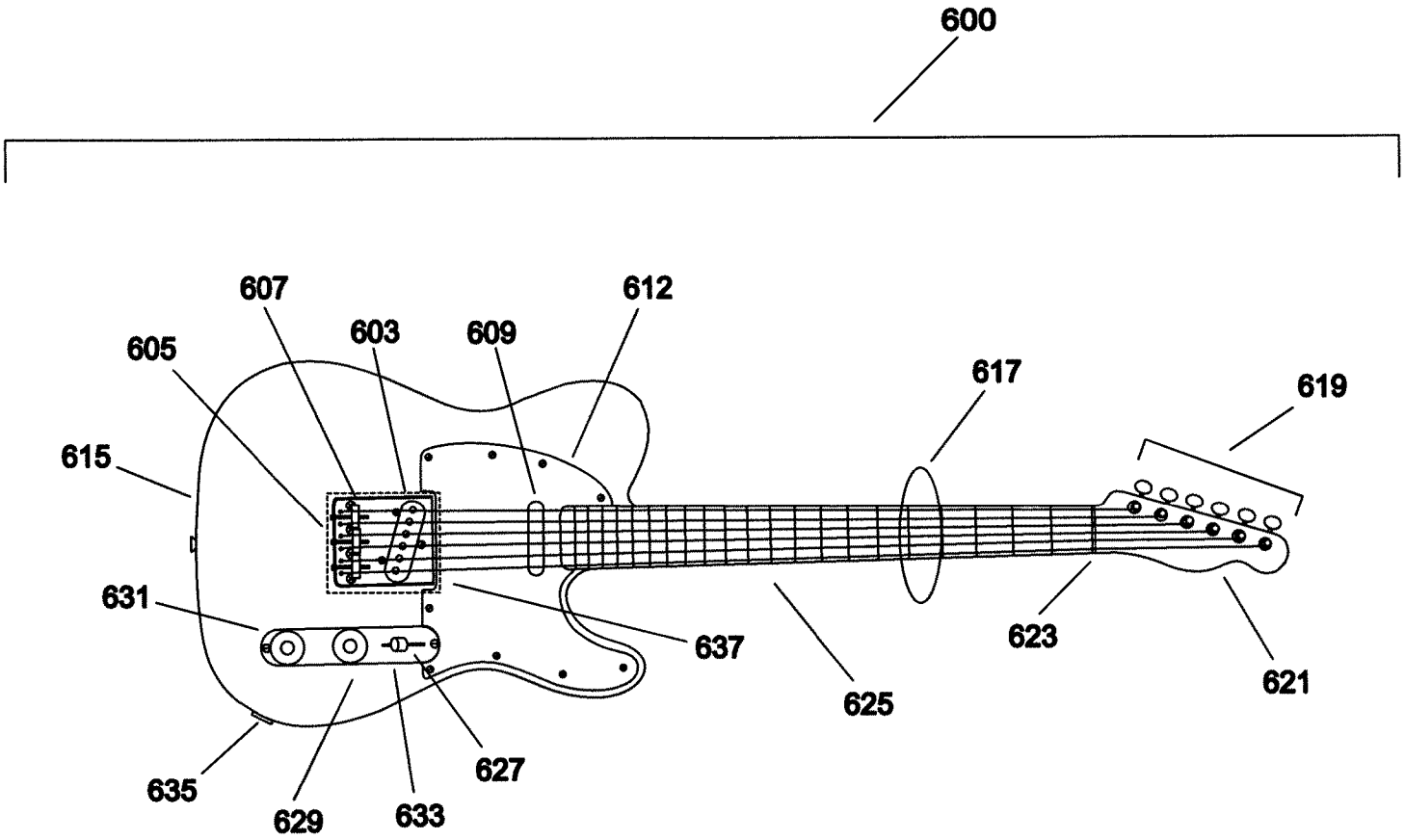
FIG. 23 is an orthographic top projection drawing of a Telecaster-style guitar.

FIG. 23 illustrates a Telecaster-style guitar 600 in which the bridge pickup 603 is mounted on a multifunctional bridge plate 605 that further comprises a set of adjustable bridge saddles 607. In different models, the neck pickup 609 is suspended from the pickguard 612 or attached directly to the body 615. The operation of the instrument is similar to the six-string Stratocaster 50 and Les Paul 400 guitars that are illustrated in FIG. 1 and FIG. 16, respectively. A set of six strings 617 are anchored to individual tuning machines 619 on the headstock 621, pass over the nut 623 and bridge saddles 607, and are anchored by ferrules on the back side of the body 615. The fretted neck 625 allows a musician to tune the vibrational frequency of each string in half-note steps. The conventional Telecaster control circuit comprises a three way pickup selection switch 627, an audio taper volume potentiometer 629 and a tone potentiometer 631 that are commonly mounted on a metal control plate 633 The selector switch 627 allows the outputs from the pickups 603, 609 to be routed, singly or in combination to the output jack 635. Components of the Telecaster-style guitar 600 that provide structural support for other components include the body 615, neck 625, headstock 621, machine heads 619, bridgeplate 605, saddles 607, and control plate 633. The nonstructural components include the pickups 603, 609, the volume potentiometer, 629, the tone potentiometer 631, the three-way switch 627 and the output jack 635. The classification of the pickguard 612 is determined by the structure (pickguard 612 or body 615) to which the neck pickup 609 is secured.

Figure 24A:
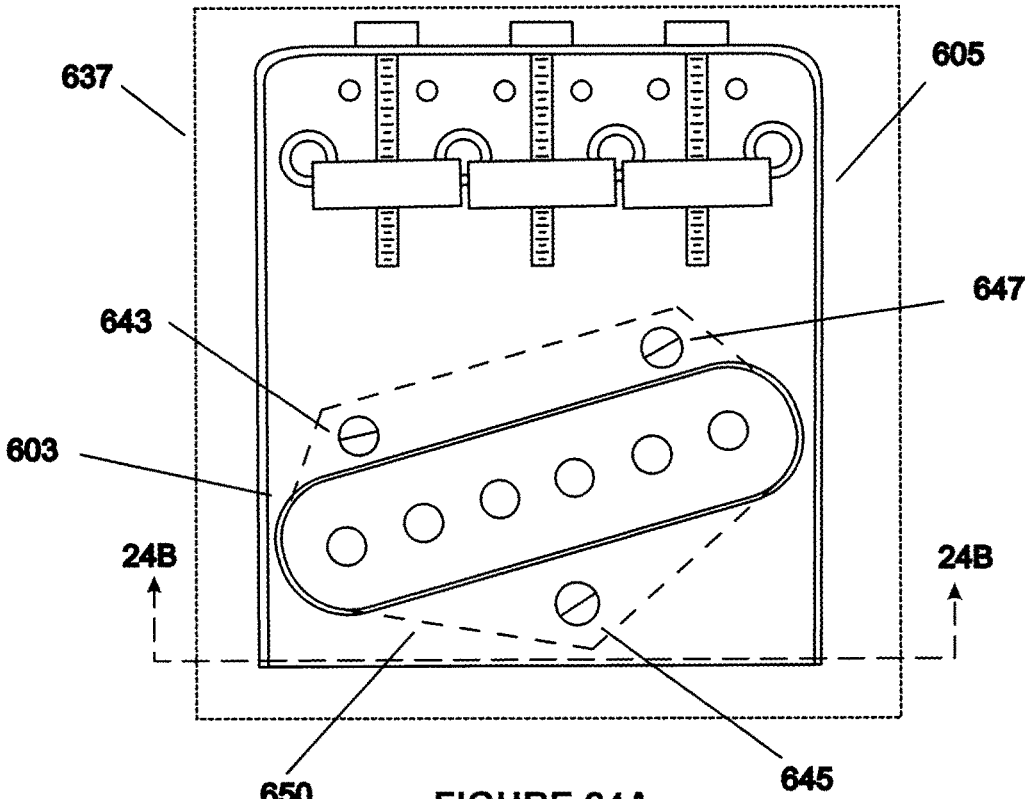
FIG. 24(A) is an orthographic top projection drawing of the bridge plate and bridge pickup of a Telecaster-style guitar.
Figure 24B:
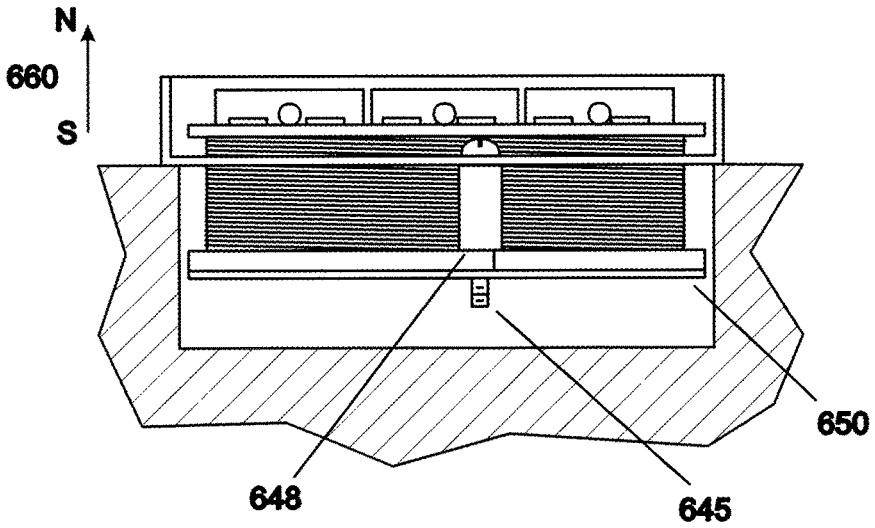
FIG. 24(B) is a sectional front view of the bridge plate and bridge pickup taken along the line 24B-24B.

The bridge plate 605, bridge pickup 603 and the region of the guitar body 615 that is surrounded by the dotted rectangle 637 are illustrated in the sectioned orthographic projection drawing of FIGS. 24(A)-24(B). For purposes of clarity, the strings and bridge plate mounting screws have been omitted from FIGS. 24(A)-24(B). The pickup 603 has a conventional single coil design with six magnetized Alnico pole pieces. It is suspended from the bridge plate 605 by three screws 643, 645, 647 that are tensioned by rubber tubes, such as the tube 648 that surrounds the screw 645, and threaded into a metal backplate 650 that is attached to the pickup.

The metal backplate 650 partially shields the pickup 603 from electromagnetic interference and, depending on the material from which it is fabricated, may also increase the inductance of the pickup 603, increase the ferromagnetic losses of the magnetic circuit that comprises the pickup 603, the instrument strings 617, and the backplate 650, and modify the field distribution of the magnetic circuit that comprises the pickup and strings.

Most Telecaster bridge pickups have a backplate 650 that is formed from a ferromagnetic material (typically low carbon steel that is coated with a thin layer of copper). Ferromagnetic backplates increase the inductance of the pickup and further affect the tone by adding loss and modifying the field distribution of the magnetic circuit. Alternative Telecaster bridge pickup designs may incorporate metal backplates that are not ferromagnetic and, in such cases, the plate does not affect the inductance of the pickup or the spatial distribution of the magnetic field surrounding it.

Figure 25A:
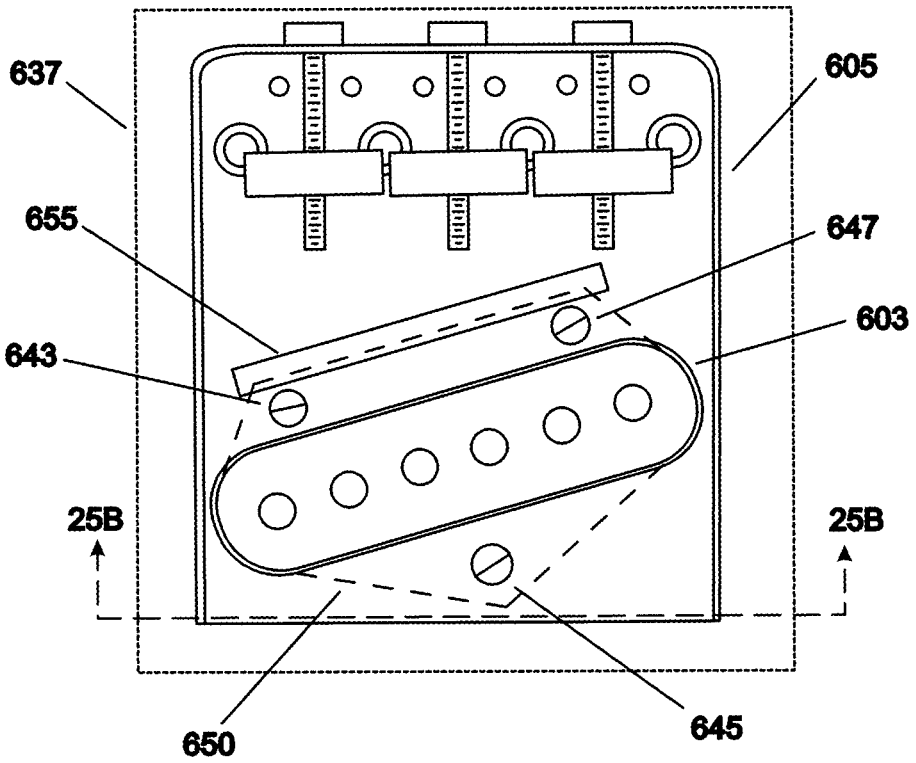
FIG. 25(A) is an orthographic top projection drawing of an embodiment of the invention that comprises a Telecaster-style bridge pickup and a ferromagnetic tone shaper.
Figure 25B:
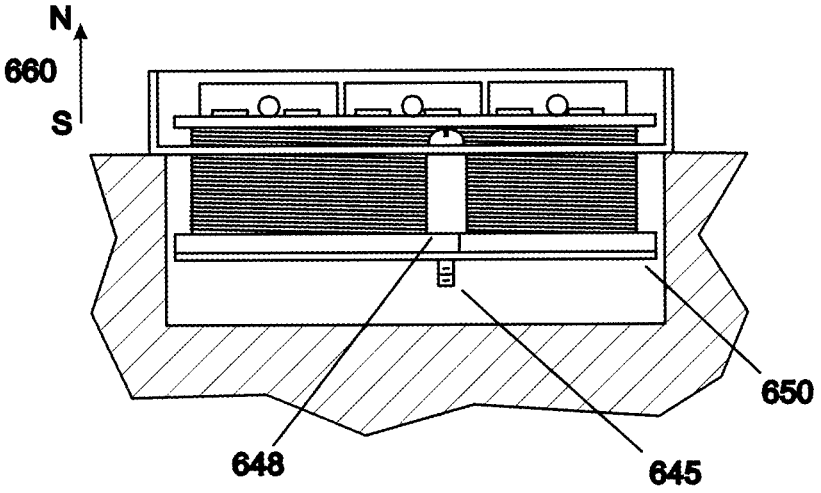
FIG. 25(B) is a sectional front view of the bridge pickup and tone shaper taken along the line 25B-25B

In an embodiment of the invention that is illustrated in FIGS. 25(A)-25(B), a magnetic pickup system that comprises the Telecaster-style bridge pickup 603 and the nonstructural ferromagnetic loss element 655 are attached to the bridge plate 605. The pickup 603 has a conventional backplate 650 that is fabricated from copper-coated, ferromagnetic steel that is attached to the bridge plate 605 by the tensioned screws 643, 645, 647. The outline of the backplate 650 is shown as a dashed line in FIG. 25(A).

The nonstructural ferromagnetic tone shaper 655 is attached to the top surface of the bridge plate 605 using a conventional tape or adhesive. The tone shaper 655 is formed from a 0.030" thick strip of bound granulated material comprising Alnico 3 granules and high solid acrylic gel art medium in the initial volume ration of 1:8. The Alnico 3 granules are magnetized in a direction that is opposite to the magnetization direction of the pickup pole pieces as indicated by the arrow 660 but, in alternative embodiments, the magnetization direction of the tone shaper 655 may be oriented at any combination of azimuthal and zenith polar angles with respect to the pole magnetization direction 660. The tone shaper may also be magnetized to any degree and, in some cases, may be essentially unmagnetized.

In contrast to Stratocaster-style single-coil pickups, such as the pickup 66 that is illustrated in FIG. 1 and FIG. 9, the magnetic field that surrounds the Telecaster bridge pickup with a ferromagnetic backplate extends significantly beyond the pickup winding and, in many cases, a magnetized hard ferromagnetic component is not required to magnetically couple a tone shaper to the pickup.

In further embodiments, pickup systems according to the present invention may comprise Telecaster bridge pickups with nonconventional designs and backplates that are absent or fabricated from various ferromagnetic and nonferromagnetic conductive materials. Tone shapers may have two or more components that are mounted in spatially separated locations on the bridge plate 605 or bonded to form a single composite structure as previously described in this application. The magnetic field of a conventional telecaster bridge pickup with a copper coated steel backplate extends at least to the edges of the backplate and ferromagnetic loss elements may be conveniently attached to a bridge plate, such as the bridge plate 605 that is illustrated in FIG. 23-FIG. 25(B), in multiple positions above the backplate edges that are indicated by the dotted outline of the pickup 650.

In many cases, a nonstructural ferromagnetic tone shaper with one or more components may be easily attached to an existing instrument in order to modify the tonal properties of a pickup that are mounted on the instrument. The invention is, therefore, further embodied in methods for retrofitting and changing the tone of a pickup that is attached to an instrument by mounting a ferromagnetic tone shaper on the instrument in such a way that it is magnetically coupled, spatially separated and electrically disconnected from the pickup. In certain embodiments of the method, the surface of a tone shaper, such as the magnetized hard ferromagnetic tone shaper 275 that is illustrated in FIGS. 9(A)-9(C), the tone shaper 455 that is illustrated in FIGS. 17(A)-17(C), the tone shaper that comprises the composite components 565, 560 in FIGS. 22(A)-22(B) or the tone shaper 655 that is illustrated in FIGS. 25(A)-25(B), may be coated with peel-and-stick adhesives that facilitate mounting them on an instrument. In further embodiments, tone shaper components may be attached using conventional adhesives, screws or other fasteners.

Nonstructural tone shapers may also be embedded or bonded to a pickguard, pickup ring or bridge plate and the instrument retrofitted by replacing a corresponding component that is originally attached to the instrument. It is a common practice, for example, for owners of Stratocaster style guitars to retrofit their instruments with new pickguards in order to change the cosmetics or tonal properties of the guitar. Pickguards that comprise one or more embedded tone shapers according to the present invention significantly increase the range and magnitude of the tonal changes that can be obtained by retrofitting an instrument with a new pickguard. The inventive method may also be practiced by retrofitting a Les Paul or similar guitar with a tone shaping pickup ring that is fabricated from a material that comprises a granulated ferromagnetic material and a structural binder or a Telecaster with a tone shaping bridge plate. While somewhat more expensive and complicated than attaching one or more self-adhesive tone shaper components to an instrument, tone shapers that are embedded or attached to the underside of pickguard, pickup ring, bridge plate or other structure may be hidden from view after installation to preserve the visual appearance of an instrument Tone shapers may also comprise replacement structures that are formed from a ferromagnetic material.

Those skilled in the art of pickup design and manufacture will realize that the embodiments described herein are illustrative and pickup systems according to the present invention may comprise a wide range of different magnetic pickup designs. It will be further realized that the mounting configurations that are detailed in this application are representative of the large number of ways that ferromagnetic tone shaper components that are spatially-separated, electrically disconnected and magnetically-coupled to a pickup may be attached to a musical instrument.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A magnetic pickup system for detecting the vibration of ferromagnetic strings in a musical instrument, the pickup system comprising:

a magnetic pickup that comprises one or more ferromagnetic string-sensing pole pieces;

at least one wire coil that surrounds at least a portion of each of the one or more ferromagnetic pole pieces;

a magnetic source associated with each of the one or more ferromagnetic pole pieces that creates a magnetic field distribution in each of the one or more ferromagnetic pole pieces;

a pickup mounting structure that holds the magnetic source, the one of more ferromagnetic pole pieces and the at least one wire coil in substantially stable relative positions and enables their attachment to the musical instrument;

a ferromagnetic tone shaper magnetically but not electrically coupled to the magnetic pickup, the tone shaper comprising at least one ferromagnetic component formed from a material selected from a group of (a) hard ferromagnetic materials and (b) materials comprising at least one granulated ferromagnetic material and a binding compound; and wherein the magnetic pickup and the ferromagnetic tone shaper are spatially separated when the pickup system is attached to the musical instrument.

2. The magnetic pickup system of claim 1 wherein the magnetic pickup is a humbucking pickup.

3. The magnetic pickup system of claim 1 wherein the magnetic pickup is a single coil pickup.

4. The magnetic pickup system of claim 3 wherein the single coil pickup is a noise-cancelling pickup.

5. The magnetic pickup system of claim 1 wherein the magnetic pickup has a split humbucking design.

6. The magnetic pickup system of claim 1 wherein the at least one ferromagnetic component of the tone shaper is formed from a hard ferromagnetic material.

7. The magnetic pickup system of claim 6 wherein the hard ferromagnetic material is a hysteresis material.

8. The magnetic pickup system of claim 6 wherein the hard ferromagnetic material is a bonded hard ferromagnetic material.

9. The magnetic pickup system of claim 1 wherein the at least one ferromagnetic component of the tone shaper is formed from a material that is selected from the group of (a) hard ferromagnetic materials and (b) materials comprising at least one granulated ferromagnetic material and a binding compound is a first component and the tone shaper comprises one or more additional components that are fabricated from materials with ferromagnetic properties that differ from the properties of the first component.

10. The magnetic pickup system of claim 1 wherein the at least one ferromagnetic component of the tone shaper comprises at least one granulated ferromagnetic material and a binding compound.

11. The magnetic pickup system of claim 10 wherein the binding compound is an electrical insulator.

12. The magnetic pickup system of claim 1 wherein the tone shaper further comprises one or more components that are formed from a soft ferromagnetic material.

13. A magnetic pickup system for detecting the vibration of ferromagnetic strings in a musical instrument, the pickup system comprising:

a magnetic pickup comprising one or more ferromagnetic pole pieces, at least one wire coil that surrounds at least a portion of each of the one or more ferromagnetic pole pieces, a magnetic source associated with each of the one or more ferromagnetic pole pieces that creates a magnetic field distribution in each of the one or more ferromagnetic pole pieces, and a mounting structure that holds the magnetic source, the one or more ferromagnetic pole pieces and the coil in substantially stable relative positions and enables their attachment to the musical instrument;

a composite ferromagnetic tone shaper magnetically but not electrically coupled to the magnetic pickup, the composite tone shaper comprising a first ferromagnetic component fabricated from a first ferromagnetic material and at least one other ferromagnetic component fabricated from a ferromagnetic material with ferromagnetic properties that are different than the properties of the first ferromagnetic material; and wherein the magnetic pickup and the composite ferromagnetic tone shaper are spatially separated when the pickup system is attached to the musical instrument.

14. The magnetic pickup system of claim 13 wherein at least one of the first ferromagnetic component and the at least one other ferromagnetic component is formed from a hard ferromagnetic material.

15. The magnetic pickup system of claim 13 wherein one or more of the ferromagnetic components of the composite tone shaper are formed from a soft ferromagnetic material.

16. The magnetic pickup system of claim 13 wherein one or more of the ferromagnetic components of the composite tone shaper are formed from a material comprising a granulated ferromagnetic material and a binder.

17. A method of retrofitting and changing the tonal properties of a magnetic pickup that is mounted in a musical instrument for sensing the vibration of ferromagnetic strings, the pickup comprising one or more ferromagnetic pole pieces; a magnetic source associated with each of the one or more ferromagnetic pole pieces that generates a magnetic field in each of the one or more ferromagnetic pole pieces and one or more of the ferromagnetic instrument strings when the pickup is mounted in the instrument; a wire coil surrounding at least a portion of the one or more ferromagnetic pole pieces; and a mounting structure that secures the one or more ferromagnetic pole pieces and the wire coil in substantially stable relative positions and enables their attachment to the musical instrument, the method comprising the step of:

affixing a tone shaper that has no structural support function to the musical instrument so that the tone shaper is magnetically coupled to the magnetic pickup, spatially separated from the pickup, and electrically disconnected from the pickup.

18. The method of claim 17 wherein at least one component of the tone shaper is fabricated from a material comprising a granulated ferromagnetic material and a binder.

19. The method claim 17 wherein at least one component of the tone shaper is fabricated from a hard ferromagnetic material.

20. The method of claim 17 wherein at least one component of the tone shaper is fabricated from a soft ferromagnetic material.

21. The method of claim 17 wherein the tone shaper comprises a first component and one or more additional tone shaper components such that the first component of the tone shaper is fabricated from a first ferromagnetic material and at least one of the one or more additional tone shaper components is fabricated from a material with ferromagnetic properties that differ from the properties of the first tone shaper component.

22. The method of claim 17 wherein the tone shaper is embedded in a structurally supportive component of the musical instrument and the magnetic pickup is retrofitted by replacing a component of the musical instrument with the component comprising the embedded tone shaper.

23. A magnetic pickup system for detecting vibrations of ferromagnetic strings on a musical instrument, the pickup system comprising:

a magnetic pickup comprising one or more ferromagnetic pole pieces for sensing the vibrations of one or more ferromagnetic strings;

at least one wire coil surrounding at least a portion of each of the one or more ferromagnetic pole pieces;

a magnetic source associated with each of the one or more ferromagnetic pole pieces that creates a magnetic field distribution in each of the one or more pole pieces;

means for holding the magnetic source, the one or more ferromagnetic pole pieces and the at least one wire coil in substantially stable relative positions and enabling their attachment to the musical instrument; and means secured to the musical instrument for shaping a tone of the magnetic pickup produced in response to the vibrations of the one of more ferromagnetic strings with the means neither physically contacting the pickup nor having a substantial structural support function.

24. The pickup system of claim 23 wherein the means for shaping the pickup tone comprises a hard ferromagnetic material.

25. The pickup system of claim 23 wherein the means for shaping the pickup tone comprises a first component that is fabricated from a first ferromagnetic material and at least one additional component that is fabricated from a ferromagnetic material with properties that differ from the properties of the first ferromagnetic material.

26. The pickup system of claim 23 wherein the means for shaping the pickup tone comprises a granular ferromagnetic material and a binder.

27. The pickup system of claim 23 wherein means for shaping the pickup tone is secured to a bridge plate.

28. The pickup system of claim 23 wherein the means for shaping the pickup tone is secured to a pickguard.

29. The pickup system of claim 23 wherein the at least one wire coil comprises two or more wire coils.

30. The pickup system of claim 23 wherein the magnetic pickup is a single coil pickup.

* * * * *